US008333722B2

(12) United States Patent
Ewing

(10) Patent No.: US 8,333,722 B2
(45) Date of Patent: Dec. 18, 2012

(54) COMMUNICATIONS DURING REHABILITATION

(76) Inventor: Paul Ewing, Franklin, MI (US)

( * ) Notice: Subject to any disclaimer, the term of this patent is extended or adjusted under 35 U.S.C. 154(b) by 0 days.

(21) Appl. No.: 12/797,065

(22) Filed: Jun. 9, 2010

(65) Prior Publication Data

US 2010/0249672 A1 Sep. 30, 2010

Related U.S. Application Data

(63) Continuation-in-part of application No. 11/585,427, filed on Oct. 24, 2006, now Pat. No. 7,762,963.

(51) Int. Cl.
*A61H 1/00* (2006.01)
*A61H 1/02* (2006.01)
*A61H 5/00* (2006.01)

(52) U.S. Cl. ..... 601/5; 482/907

(58) Field of Classification Search ..... 482/1, 8–9, 482/900–901; 601/5, 23, 33–36; 600/300, 600/587, 595; *A61H 1/00, 5/00*
See application file for complete search history.

(56) References Cited

U.S. PATENT DOCUMENTS

| | | | | |
|---|---|---|---|---|
| 4,621,620 | A * | 11/1986 | Anderson | 601/34 |
| 5,980,435 | A * | 11/1999 | Joutras et al. | 482/114 |
| 6,296,595 | B1 * | 10/2001 | Stark et al. | 482/91 |
| 6,599,255 | B2 * | 7/2003 | Zhang | 600/587 |
| 6,872,187 | B1 * | 3/2005 | Stark et al. | 602/16 |
| 6,969,365 | B2 * | 11/2005 | Scorvo | 602/16 |
| 7,632,216 | B2 * | 12/2009 | Rahman et al. | 482/8 |
| 7,695,416 | B2 * | 4/2010 | Weiner | 482/137 |
| 2006/0288781 | A1 * | 12/2006 | Daumer et al. | 73/510 |
| 2007/0093729 | A1 * | 4/2007 | Ewing | 601/5 |
| 2007/0184518 | A1 * | 8/2007 | Marshall et al. | 435/68.1 |
| 2008/0300914 | A1 * | 12/2008 | Karkanias et al. | 705/2 |

FOREIGN PATENT DOCUMENTS

WO WO03/105744 A2 * 12/2003

* cited by examiner

*Primary Examiner* — Oren Ginsberg

(57) ABSTRACT

A method, includes recording first regimen data in a controller. The first regimen data includes instructions for a therapeutic regimen. The method also includes controlling a therapeutic device in accordance with at least the first regimen data, and recording progress data representative of at least an amount of force exerted on a joint during each of a plurality of cycles and the number of cycles performed. The method also includes transmitting the progress data from the controller to a remote user, and receiving an input from the remote user containing second regimen data. The second regimen data is different from the first regimen data. The method further includes controlling the therapeutic device in accordance with at least the second regimen data.

20 Claims, 17 Drawing Sheets

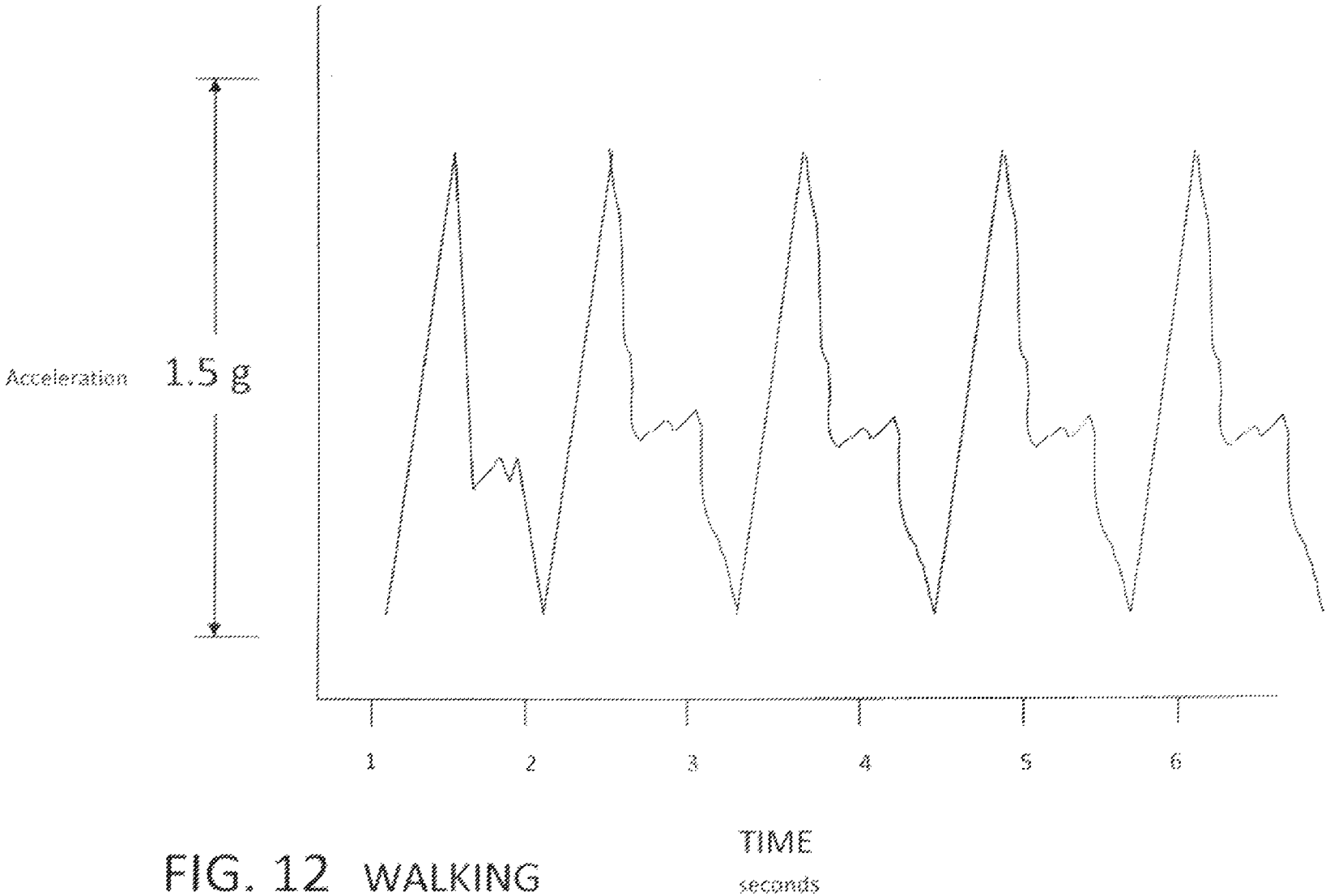
FIG. 12 WALKING

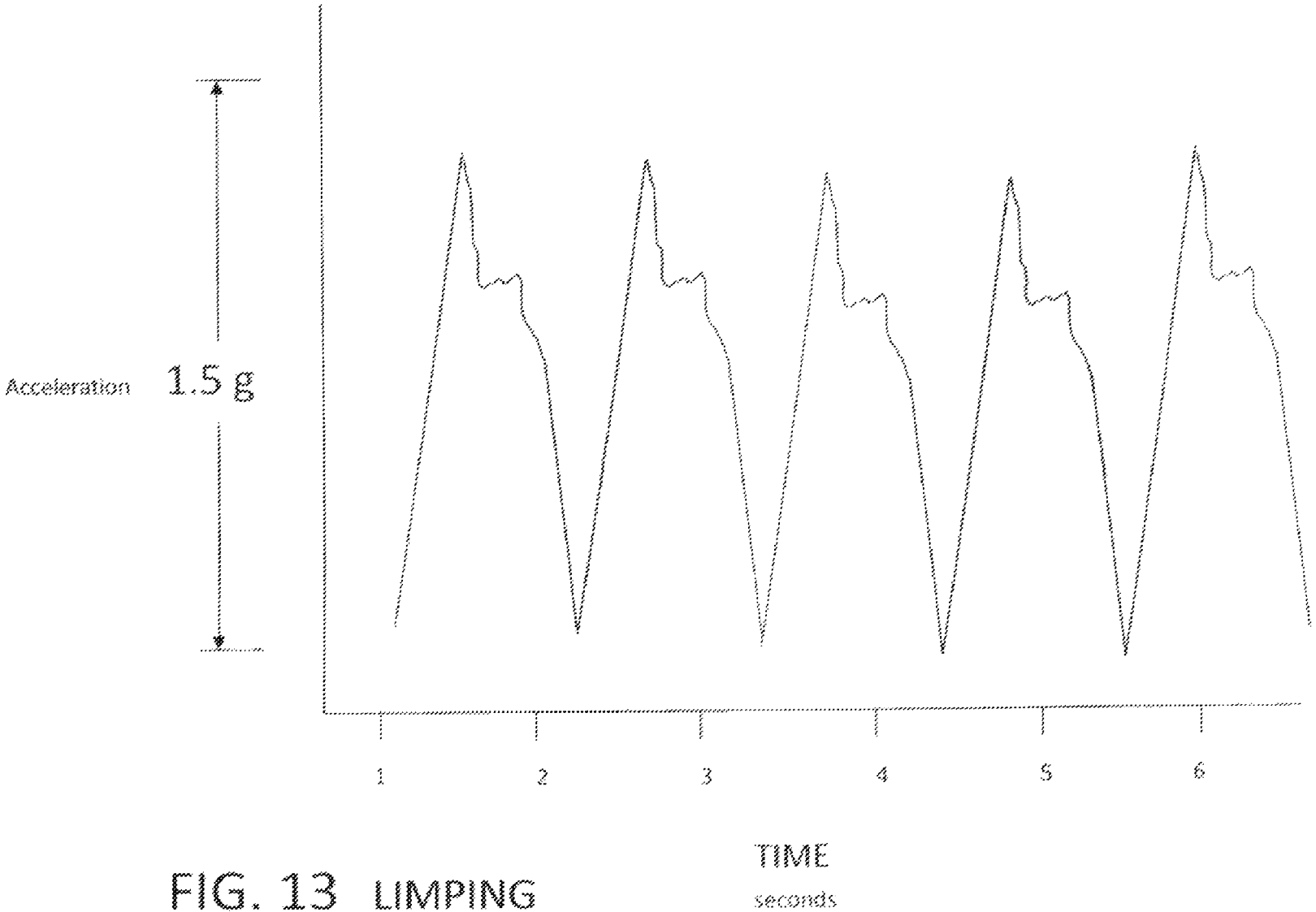
FIG. 13 LIMPING

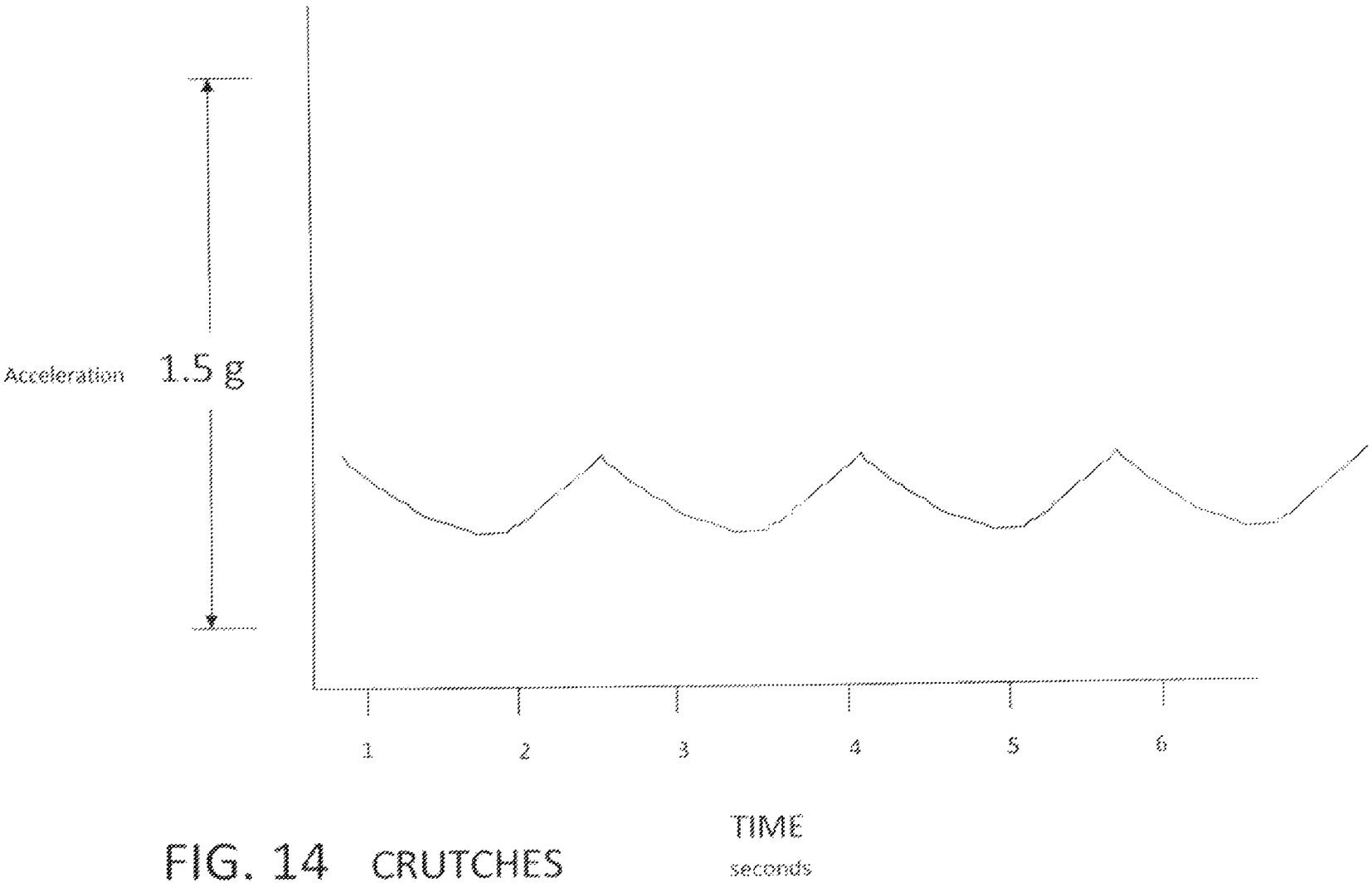
FIG. 14 CRUTCHES

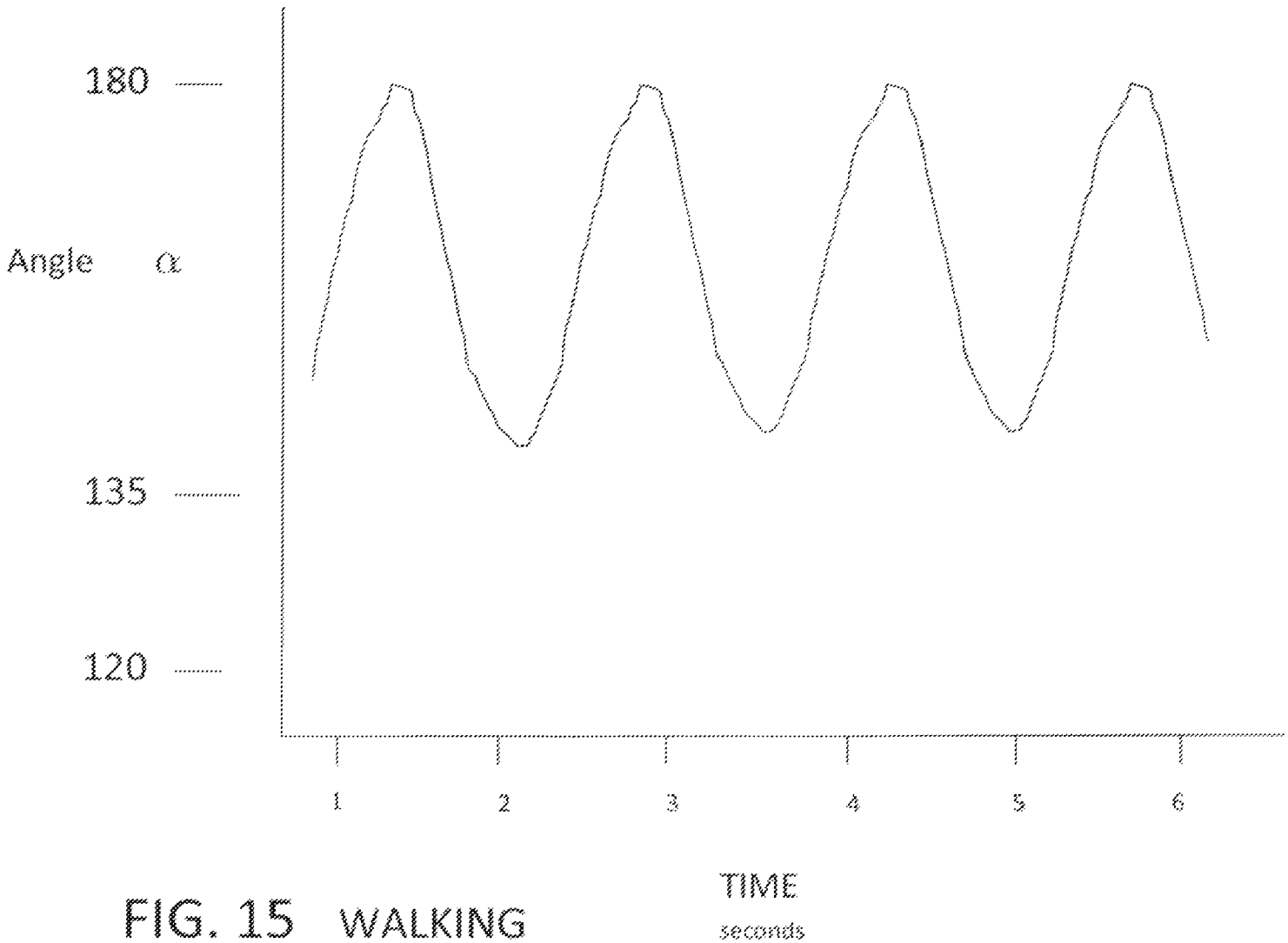
FIG. 15 WALKING

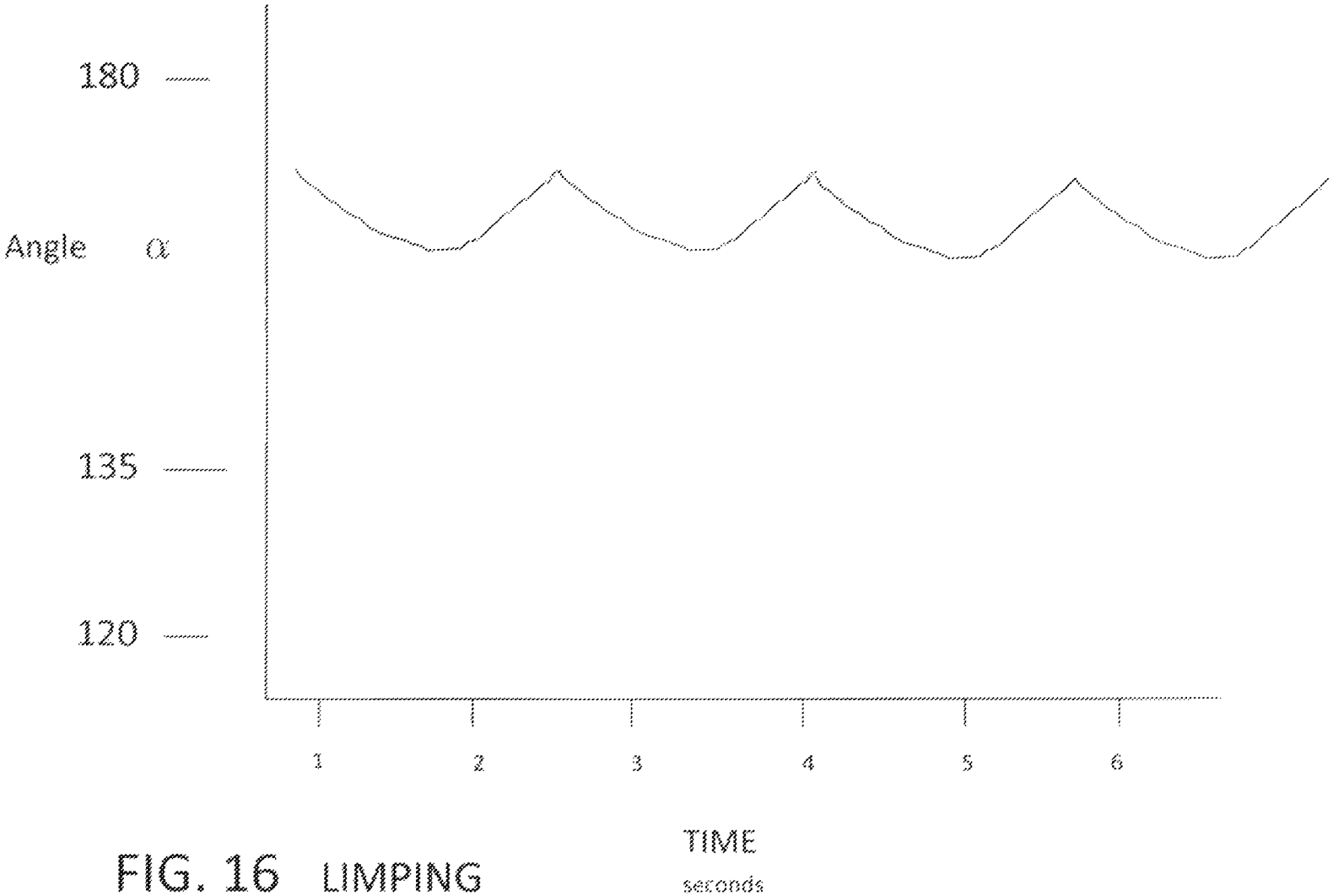
FIG. 16 LIMPING

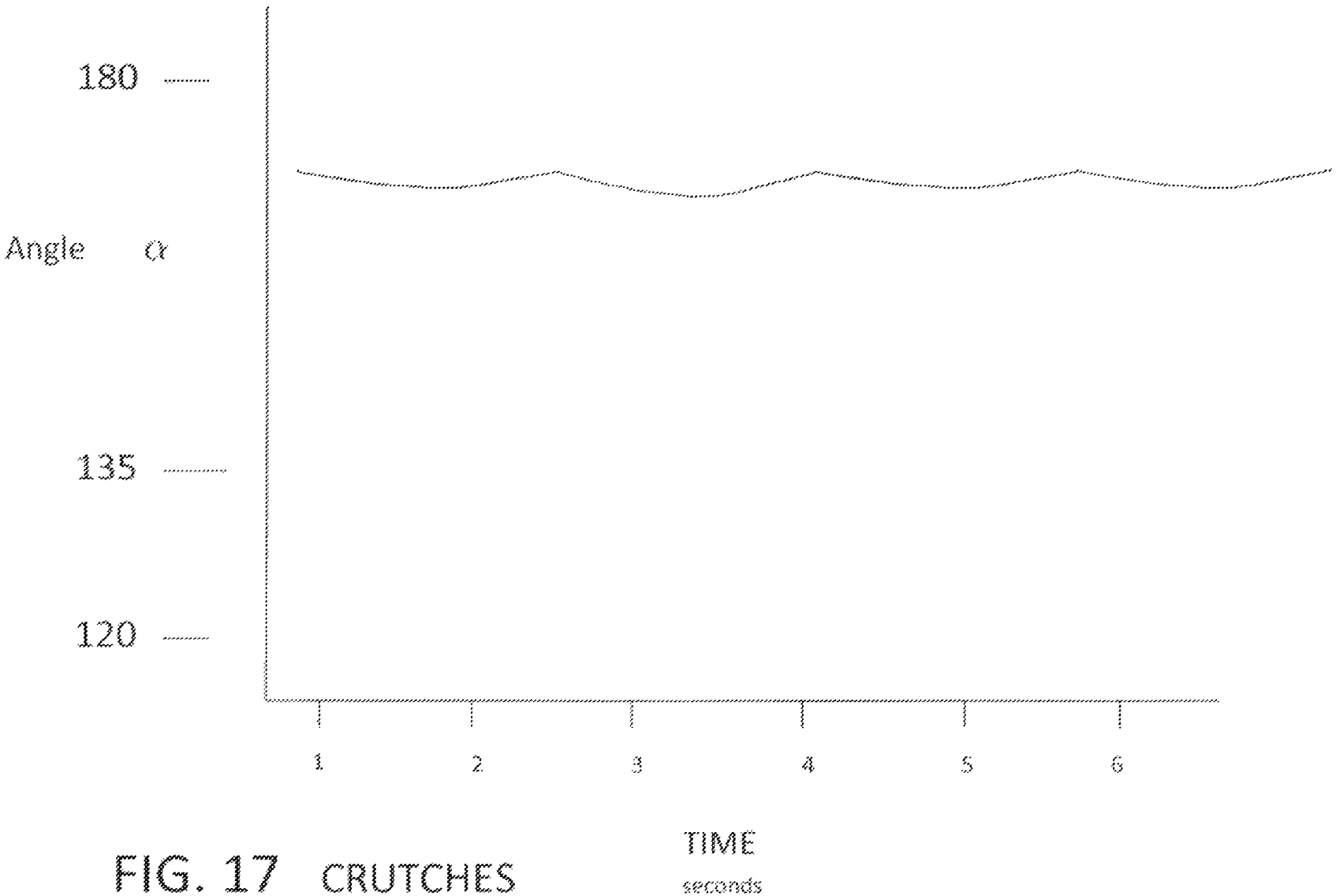
FIG. 17 CRUTCHES

COMMUNICATIONS DURING REHABILITATION

CROSS REFERENCE TO RELATED APPLICATIONS

This application is a Continuation-in-Part of U.S. application Ser. No. 11/585,427, filed on Oct. 24, 2006; which claims priority to U.S. Application 60/729,698, filed Oct. 24, 2005; the disclosures of which are incorporated by reference in their entireties.

TECHNICAL FIELD

The disclosure generally relates to rehabilitative devices, and more particularly to a rehabilitative joint extension device and method that helps increase the range of motion of an injured or recovering joint.

BACKGROUND

The range of motion of a joint is generally measured with a goniometer. For the knee, this range of motion is typically the angle between the femur and the tibia. For many people, a desired full range of motion is between a most extended position and a fully flexed position. Typically, this most extended position will be beyond a full extension (angle of 0°) and includes hyper extension of about −5° to about −10°. The fully flexed position may be about 135°.

It is not uncommon following a knee injury or knee surgery for a patient to have difficulty moving their knee through the full range of motion, particularly extending their knee to its most extended position. Rehabilitation of the knee, by rotation of the tibia relative to the femur through a range of motion that is achievable, is typically used to attain a greater range of motion as rotation will provide benefits, such as stretching the ligaments that may limit the range of motion to a range less than desired. Rotation of a joint from any given angle toward flexion or extension and counter-rotation of the joint, where the joint has been moved generally to about a maximum angle of attainable flexion and to about a minimum angle of attainable extension, and returning to the given angle, is generally referred to as a cycle.

In an example where an anterior cruciate ligament (ACL) of the knee has been replaced, the ACL may be connected within the knee in a shorter configuration than had previously existed. This shorter connection may be advised since the new ACL may be stretched to achieve the proper length, while a new ACL that is longer than previously existed may result in a 'loose' knee that may never 'tighten' since the ACL may never shorten. Extension of the leg to stretch and lengthen a newly replaced ACL in order to properly size the ligament is generally performed by a properly trained physical therapist and typically involves pushing on the knee cap to straighten, or extend the knee coupled with other exercises.

A common technique for accomplishing such rehabilitation is to exercise a joint, such as the knee, (rotation and counter-rotation of the joint involving multiple cycles) to gradually increase the knee's range of motion, with the assistance of either a machine or by a properly trained person. Such techniques often use a hinge strapped to the knee to prevent extension or flexion into an undesired range of motion (such as, for example, less than 10° extension) while exerting a force to urge the knee toward 10° of extension. Various types of machines are known in the art for providing such rehabilitation, including those shown in U.S. Pat. No. 5,509,894 to Mason; U.S. Pat. No. 5,356,362 to Becker; U.S. Pat. No. 5,333,604 to Green; and U.S. Pat. No. 5,313,094 to Bonutti, to name a few.

However, many machines or methods may exercise a joint, such as a knee, while not providing 1.) adequate measurement of the amount of force used to urge the joint toward extension or flexion. 2.) consistent forces to urge the knee toward full flexion or full extension during subsequent cycles, 3.) adequate measurement of the angles of flexion or extension attained for the range of motion experienced. 4.) consistency in the angles of flexion or extension for the range of motion experienced during subsequent cycles. 5.) a verifiable record of the therapeutic session, including angles of flexion and extension, and number of cycles and/or 6.) communications between the device and a health care provider (such as a Doctor, Therapist, or Insurance Company) to relay information related to confirming that the therapeutic session has been performed.

Furthermore, many devices require constant assistance by a trained physical therapist, thereby restricting the patient's self-directed use of a device and increasing the expense of rehabilitation. What is needed, therefore, is a versatile, easy to use, and/or repeatable device for gradually increasing the range of motion of an injured or recovering knee.

Another concern is that a health care provider, such as a physician, physical therapist or occupational therapist may have limited knowledge oldie actual therapeutic regimen of a patient or progress of rehabilitation. While some patients are required to exercise while not in the presence of a health care provider, the health care provider may not know whether the patient has actually performed the required regimen and may not know other information, such as whether the patient limps or uses crutches.

SUMMARY

The systems described herein assist in rehabilitation by accurately accumulating data for comparison during movement. Further, the systems may inform a health care provider of information related to the patient's progress.

BRIEF DESCRIPTION OF THE DRAWINGS

The drawings are illustrative embodiments. The drawings are not necessarily to scale and certain features may be removed, exaggerated, moved, or partially sectioned for clearer illustration. The embodiments illustrated herein are not intended to limit or restrict the claims.

FIG. 12 is a graphical illustration of simulated data recorded by an accelerometer such as illustrated in FIGS. 9 and 10.

FIG. 13 is a graphical illustration of simulated data recorded by an accelerometer such as illustrated in FIGS. 9 and 10.

FIG. 14 is a graphical illustration of simulated data recorded by an accelerometer such as illustrated in FIGS. 9 and 10.

FIG. 15 is a graphical illustration of simulated data recorded by a sensor.

FIG. 16 is a graphical illustration of simulated data recorded by a sensor.

FIG. 17 is a graphical illustration of simulated data recorded by a sensor.

DETAILED DESCRIPTION

Figure 1:
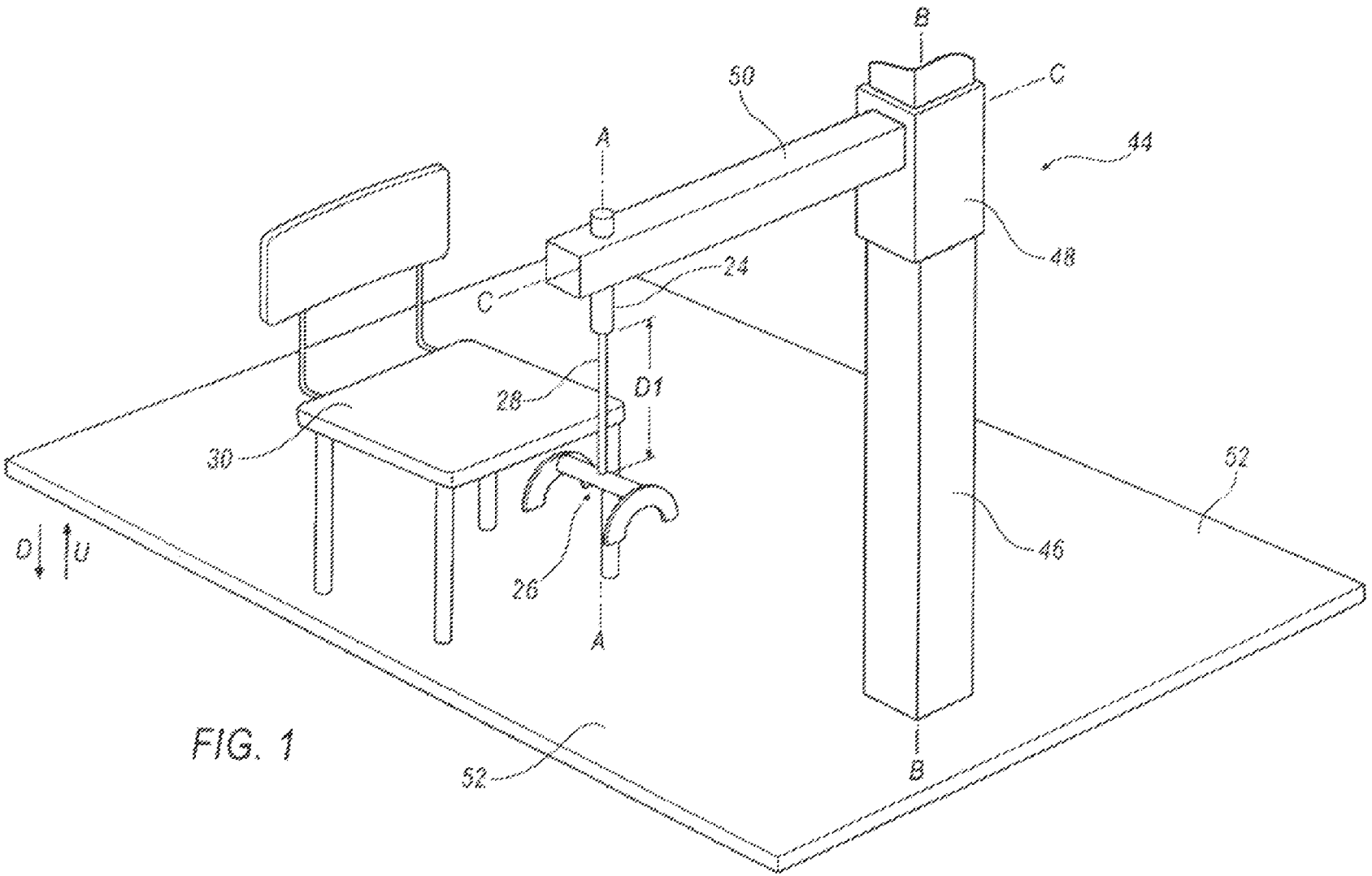
FIG. 1 is a perspective view of an apparatus according to an embodiment.
Figure 2:
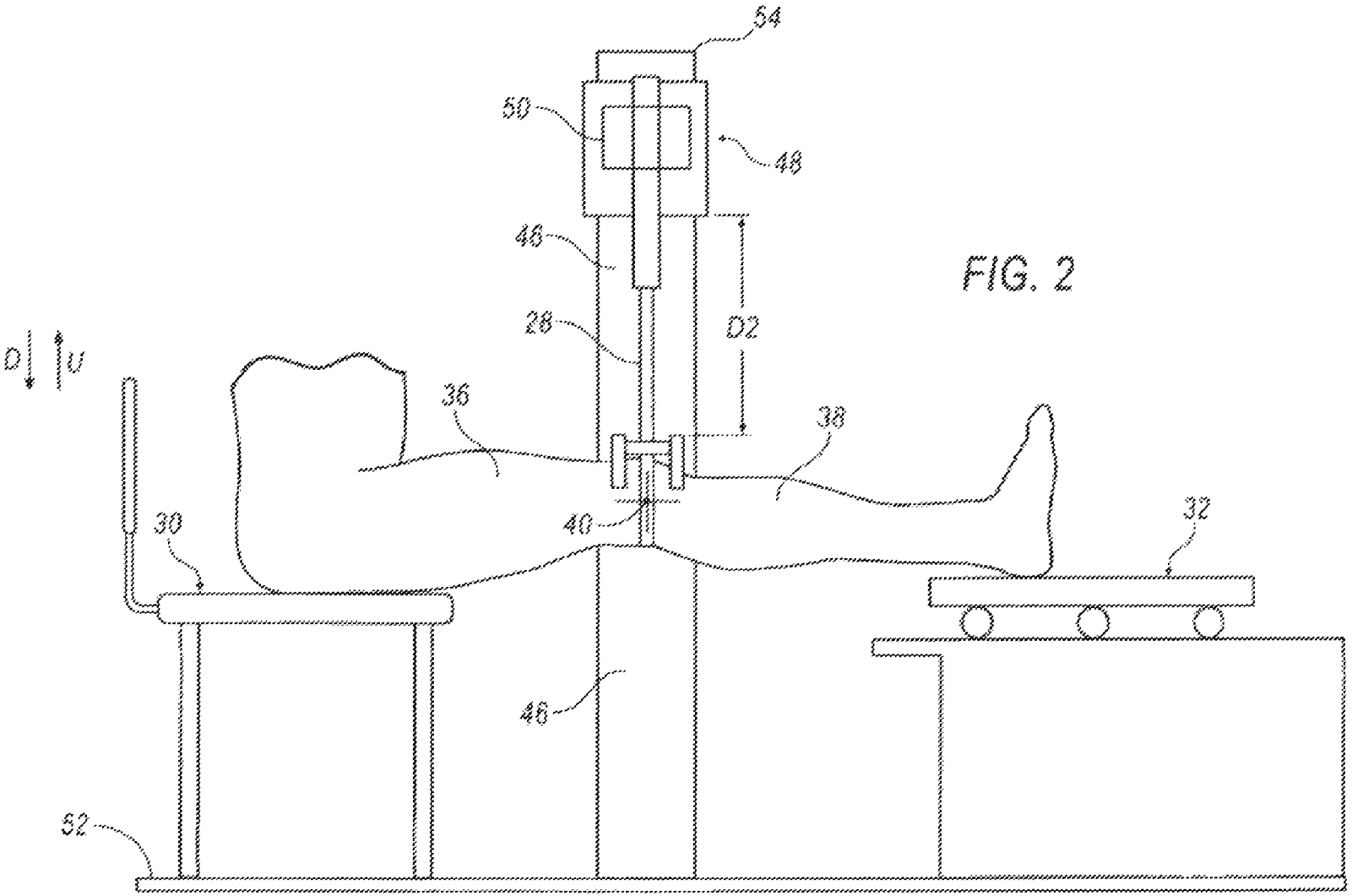
FIG. 2 is a side view of the apparatus of FIG. 1, illustrating a joint in a working position.
Figure 3:
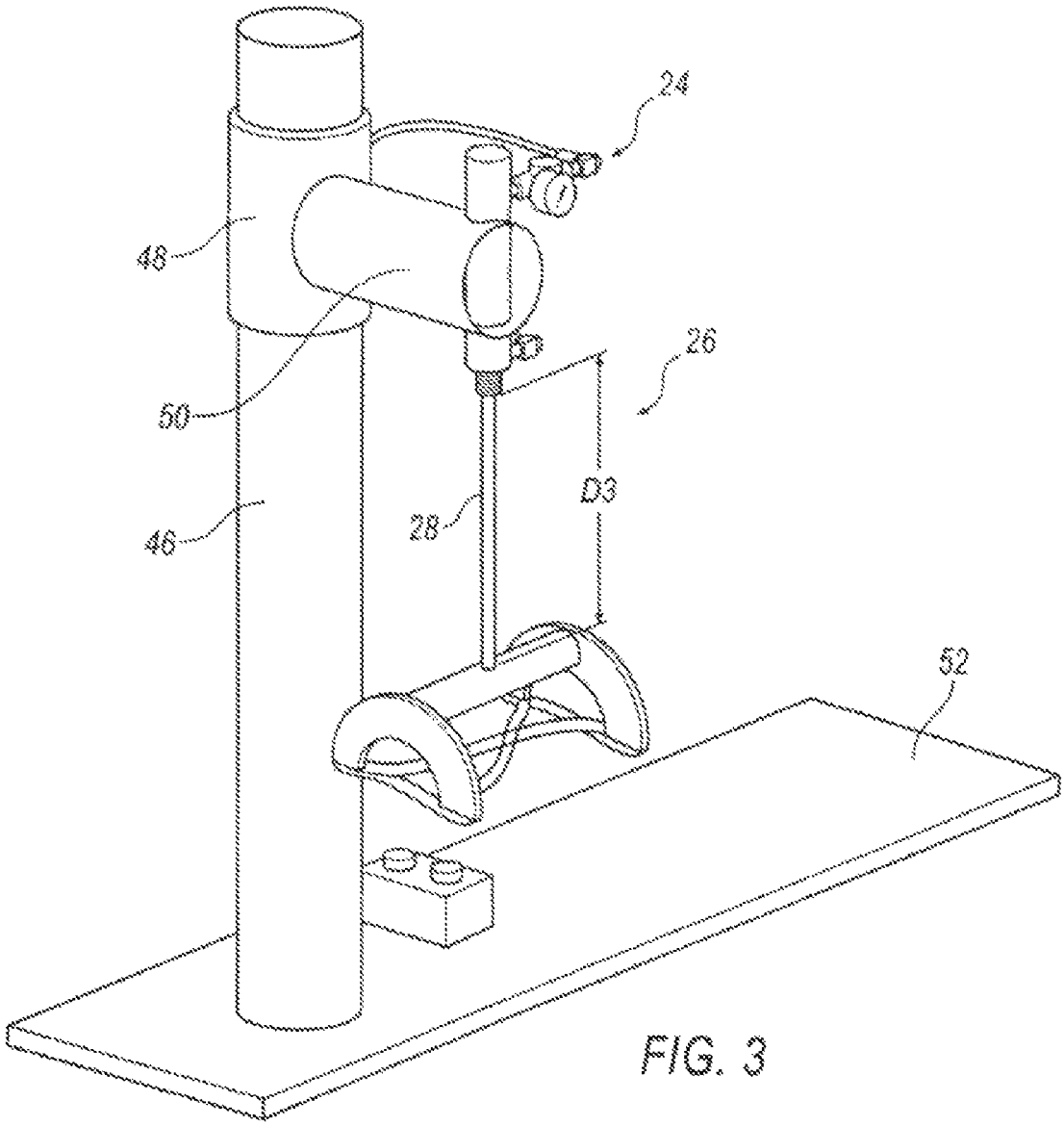
FIG. 3 is an enlarged, partial perspective view of an apparatus according to an embodiment.

FIGS. 1-3 illustrate an apparatus 20 according to an embodiment. The apparatus 20 includes a bench 22, a drive mechanism 24 having an axis A-A, and a joint manipulation portion, shown as a knee engagement portion, 26. An elongated member 28 extends from the drive mechanism 24 and attaches to the portion 26. The elongated member 28 extends from and retracts into the drive mechanism 24, as discussed in greater detail below. With respect to the particular embodiment shown here, bench 22 generally includes a first horizontal support member 30 and a second horizontal support member 32. It should be appreciated, however, that benches and other supports having one of a number of alternative designs could be used in place of the specific, preferred embodiment shown here.

FIG. 2 illustrates a portion 34 of a patient (not fully shown) positioned within the apparatus 20. The portion 34 includes a first member 36, a second member 38, and a joint 40. The joint 40 generally permits rotational movement of the first member 36 relative to the second member 38. In the embodiment illustrated, the joint 40 is a knee, with the first member 36 being a femur, and the second member 38 being a tibia, although the apparatus 20 may be adapted to exercise any joint. The first horizontal support member 30 and the second horizontal support member 32 define generally planar surfaces that provide the patient with supports for at least a portion of the first member 36 and the second member 38 to position the joint 40 within the apparatus 20.

The apparatus 20 also includes a support structure 44 for supporting and positioning the drive mechanism 24, as discussed in greater detail below. The structure 44 includes a first support member 46 having an axis B-B, a second support member 48, and a third support member 50 having an axis C-C. The tubular support members 46, 48, 50 may be made of PVC piping or another suitable material and are generally arranged to support the drive mechanism 24 so that knee engagement portion 26 can be oriented in a variety of positions.

Referring specifically to FIG. 3, the tubular support member 46 is a primary vertical support that extends from a base portion 52 (FIGS. 1 and 2), beyond the support member 30, and terminates at an upper end 54. Tubular support member 48 is preferably a T-shaped intersection that can be adjusted in at least two orientations: a first adjustment allows member 48 to be slid up (in the direction of arrow U in FIG. 2) and down in the direction of arrow D in FIG. 2) on the outside surface of the vertical member 46, while a second adjustment allows for rotation of member 48 generally about the axis B-B of the vertical member 46. Accordingly, the operator can adjust both the height and the rotational orientation of the suspended knee engagement portion 26. Tubular support member 50 acts as a cantilevered member that adjustably extends from T-shaped intersection 48 in a generally horizontal manner. As with the member 48, member 50 can be rotatably adjusted generally about the axis C-C relative to the member 48 so that the orientation of drive mechanism 24 can be either vertical (with axis A-A oriented parallel to arrows U and D) or non-vertical. Therefore, tubular support members 46, 48, 50 provide for at least three ways of adjusting the orientation of drive mechanism 24 relative to the joint 40, however, additional adjustment means could be added.

Figure 4:
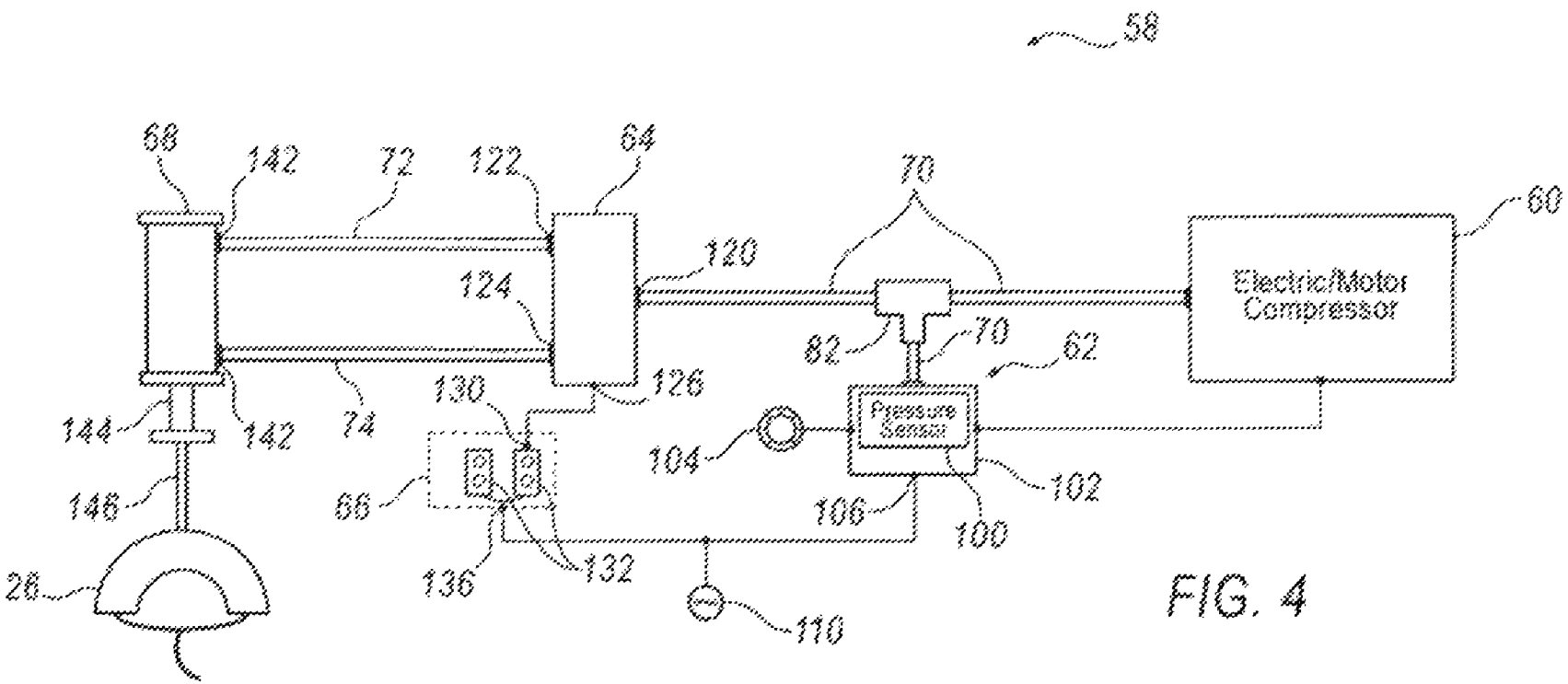
FIG. 4 is a schematic view of an operative mechanism for the apparatus of FIG. 3, according to an embodiment.

FIG. 4 schematically illustrates an embodiment of the drive mechanism 24 as a pneumatic drive mechanism 58. The drive mechanism 58 is attached to a knee engagement portion 126 (an embodiment of the knee engagement portion 26) such that it can be moved up and down in order to rotate and counter rotate the joint 40, such as the injured or recovering knee, as discussed in greater detail below. The drive mechanism 58 includes a motor/compressor (MC) 60, a motor controller 62, a valve device 64, valve controls 66, a pneumatic cylinder 68, air conduits 70-74, and the tubular support members 46, 48, 50. The MC 60 provides the pressurized air for the pneumatic drive mechanism and preferably includes an electric motor of the type commonly known in the art including AC motors, DC motors, brushed and brushless motors, to name but a few. The MC 60 preferably includes a built-in pressure safety control and quick-connect air valve couplings. The pressure safety control establishes an upper pressure limit for the system, thus allowing an operator to adjust the pressure in the various conduits up to but not surpassing, the safety limit. Quick-connect air valve couplings allow for quick and easy separation of the MC 60 from the rest of knee extension apparatus 20, which can aid in a number of endeavors ranging from transportation to maintenance activities.

Motor controller 62 regulates the air pressure in first conduit 70 so that it is maintained at an adjustable, predetermined pressure and generally includes a pressure sensor 100, a motor control circuit 102, a pressure adjustment control 104 and a power input 106. Coupling 82 is a simple T-connection which connects all of the branches of conduit 70 so that they are in fluid communication with one another and are thus at the same pressure. An operator uses pressure adjustment control 104, which is shown in the form of a knob or dial but may be any suitable user input device, to adjust a target pressure (desired pressure set by operator). Pressure sensor 100 monitors the system pressure (actual air pressure in conduit 70) and provides an electronic pressure signal representative of the pressure to motor control circuit 102. If the system pressure falls below the target pressure, then motor control circuit 102 sends an electronic control signal to the MC 60 which instructs the motor to turn on and increase the system pressure. The electronic control signal can be provided according to a number of techniques known to those skilled in the art, including pulse-width-modulation, and can alternatively be implemented as a switched source of 110 volt AC that runs the MC 60. Power input 106 is preferably coupled to a conventional 110 volt AC power source so that knee extension apparatus 20 can be used in any environment having access to standard electrical service.

Valve device 64 is preferably a two-way valve that governs the operation of pneumatic cylinder 68, and is controlled by the operator via valve controls 66. According to the embodiment shown here, valve device 64 is coupled to conduit 70 via an air input 120, it is coupled to conduits 72, 74 via first and second air outputs 122, 124, respectively, and it is coupled to valve controls 66 via a signal input 1126. If valve device 64 is operated according to a first state, it allows pressurized air from main conduit 70 to enter upper conduit 72 which thereby drives pneumatic cylinder 68 in a first or downward direction. Conversely, if the valve device is operated in a second state, then the pressurized air from main conduit 70 enters lower conduit 74 and drives the pneumatic cylinder in an opposite or upwards direction. Accordingly, valve device 64 allows pneumatic cylinder 68 to be driven in one of two different directions, depending on the input from the operator which is provided via valve controls 66.

Valve controls 66 control the state of valve device 64, as just described, and preferably include a signal output 130 coupled to signal input 1126 of the valve device, push-button controls 132, and a power input 134. Push-button controls 132, which can alternatively be one of a variety of non-push button controls such as switches, levers, touch-screens, dials, etc., enables the operator to select an upwards or downwards movement of the pneumatic cylinder 68. Moreover, it is possible to provide controls 66 such that they allow the operator to adjust the speed at which valve device 64 is opened and consequently the speed at which the pneumatic cylinder and the attached knee engagement portion 126 move. This speed control can be implemented electronically or manually, such as by controlling the flow rate of compressed air into the cylinder 68. Such techniques are known to those skilled in the art. In any event, push-button controls 132 generate an electronic valve control signal which is sent to valve device 64 via signal output 130. Like the power input previously described, power input 134 is preferably coupled to a standard 110 v AC power supply.

Pneumatic cylinder 68 is preferably a single-rod air cylinder that moves knee engagement portion 126 up and down according to the state of valve device 64. With respect to the embodiment shown here, pneumatic cylinder generally includes first and second air inputs 140, 142 coupled to conduits 72, 74, respectively, and a piston 144. The piston 144 is attached to a linear member, or rod 146 which is attached to the knee engagement portion 126, and preferably includes some type of operator-controlled adjustment for varying its range of linear motion. Thus, the overall linear range of stroke of the pneumatic cylinder, and hence the uppermost and lowermost relative positions of knee engagement portion 126, can be adjusted and set by the operator. One example of a range of stroke of the pneumatic cylinder 68 is 18 inches of axial stroke that can be limited as desired.

The knee engagement portion 126 provides a means for securely, yet comfortably, contacting the patient's knee during use of the device. According to the particular embodiment shown here, the knee engagement portion 126 includes a cross-member 180, a pair of end brackets 182, 184 and a pair of straps 186, 188. The specific cross-member 180 shown here is made from PVC piping and extends in a generally horizontal fashion so that it is firmly secured to end brackets 182, 184. End brackets 182, 184 are preferably curved so that a patient can extend the leg of the worked knee underneath the brackets with interference. Straps 186, 188 can be made of any durable material such as leather or synthetic material so long as the material is comfortable when it contacts the patient's leg just above and just below the knee.

In use, a patient is seated on bench 22. As previously mentioned, tubular support members 46, 48, 50 can be adjusted according to one of several different ways so that knee engagement portion 126 will properly contact the joint 40. Turning on drive mechanism 58 causes the MC 60 to run and thereby pressurize conduit 70 such that it reaches the target pressure, as set by pressure adjustment control 104. Activation of push-button controls 132, which can be controlled by either the patient or an authorized operator, causes valve device 64 to pressurize one of the two conduits 72, 74. If the upper conduit 72 is pressurized, pneumatic cylinder 68 is driven in a generally downwards direction until it reaches a maximum piston travel position, as set by adjustment means on the pneumatic cylinder. If the lower conduit 74 is pressurized, then piston 144 of pneumatic cylinder 68 is driven in an upwards direction so that knee engagement portion 126 is lifted from the knee to an out-of-the-way position. In either case, the operator is able to adjust the orientation, position, height, etc. of the knee engagement portion 126 so that the joint 40 may be moved, or flexed and extended, in a gradual and repeatable manner with the eventual goal being a greater extension and/or flexion, and thus range of motion, for the joint 40.

The knee extension apparatus 20 can be used to implement a particular rehabilitation program for a patient based on their individual condition. For this purpose, the device can be used for repetitive knee extension and flexion to help increase an actual range of motion and achieve a proper recovery of the joint 40 following surgery. This can be done by setting various characteristics of the extension and retraction cycle: for example, the device may be used to undergo a set of knee extensions and retractions in which the extension is limited to something less than full extension, and this limited movement can be achieved by various means such as by providing an adjustable hard stop on the drive mechanism at the cylinder 68. An adjustable hard stop could also be used at the other (retraction) end of travel. Also, the amount of time spent at the end of travel before moving back in the other direction (i.e., the dwell time) can be controlled, both at the extended position and retracted position. This dwell time can be implemented manually using the operator controls 132, or by use of one or more electronic timers that allow the entire cycle of motion to be carried out automatically. To aid in the retraction of the knee, a flexible yet resilient material can be placed under the knee to press it back towards the retracted (bent) position when the cylinder retracts. Alternatively, the knee engagement portion 126 can include a strap portion or other component that extends under the leg so that the retraction of the cylinder pulls the knee up with it.

It will thus be apparent that there has been provide in accordance with the present invention a knee extension device which achieves the aims and advantages specified herein. It will, of course, be understood that the foregoing description is of preferred exemplary embodiments of the invention and that the invention is not limited to the specific embodiments shown. Various changes and modifications will become apparent to those skilled in the art.

For example, a number of pressure gauges 200 that incorporate adjustable pressure valves, such as those seen in FIGS. 3 and 4, could be added to conduits at various locations throughout drive mechanism 58. These adjustable valves 200 allow an operator to set a pressure threshold in the corresponding conduit so that the maximum pressure is limited to that predetermined amount. According to one embodiments, pressure sensor 100 could be replaced with an adjustable valve 200 located between coupling 82 and air input 120, so that motor controller 62 maintains the pressure at junction 82 at a set pressure, yet the downstream pressure in conduit 70 is adjustable according to the target pressure set on the valve.

Furthermore, a compressor tank or compressed air receiver may be utilized so that each time the valve device 64 is operated it does not cause the MC 60 to turn on to replenish the system pressure in conduit 70. According to a particular embodiment, the compressor tank or compressed air receiver may be housed within vertical tubular support member 46 and/or one of the other tubular support members. These are, of course, only some of the changes that could be made to the plant support device disclosed herein, as all such changes and modifications are intended to be within the scope of the present invention.

Figure 5:
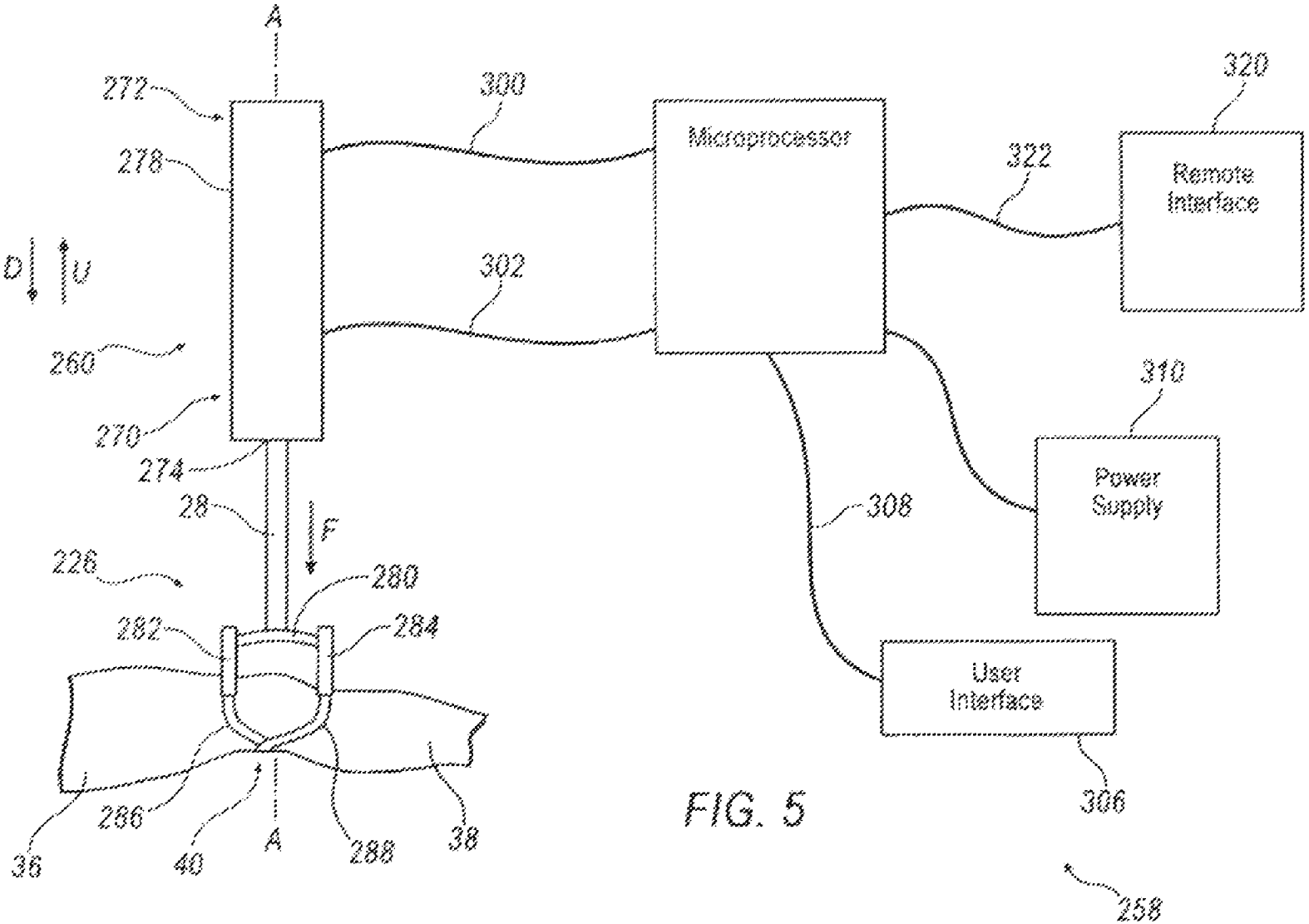
FIG. 5 is a schematic view of an operative mechanism for the apparatus of FIG. 1, according to another embodiment.

FIG. 5 illustrates an embodiment of the drive mechanism 24 as a ball-screw drive mechanism 258 and an embodiment of the knee engagement portion 26 as a knee engagement portion 226. The drive mechanism 258 is attached to the knee engagement portion 226 such that the knee engagement portion 226 can be moved up and down as the member 28 extends from and retracts into the drive mechanism 258.

The drive mechanism 258 includes a linear actuator, such as a ball screw mechanism 260, a microprocessor 262, a user interface 306, and a power supply 310. The ball screw mechanism 260 includes a ball screw 270, an electric motor 272, a load cell 274, sensors 276, and an outer casing, 278.

The knee engagement portion 226 includes a cross-member 280, a first end bracket 282, a second bracket 284 a first strap 286, and a second strap 288. The cross-member 280 extends horizontally and is attached to the end brackets 282, 284. The cross-member 280 and the end brackets 282, 284 are preferably curved so that the joint 40 may be positioned under the knee engagement portion 226 and remain in contact with the end brackets 282, 284 as the joint 40 is moved between the achievable flexed position and the achievable extended position. Straps 286, 288 are crossed under the joint 40 such that both the first strap 286 and the second strap 288 are attached to both the first end bracket 282 and the second bracket 284. In this manner, the straps 286, 288 will lilt the joint 40 as the member 28 moves up (in the direction of the arrow U) such that the joint 40 will be flexed as the angle α between the first member 36 and the second member 38 increases.

Figure 6:
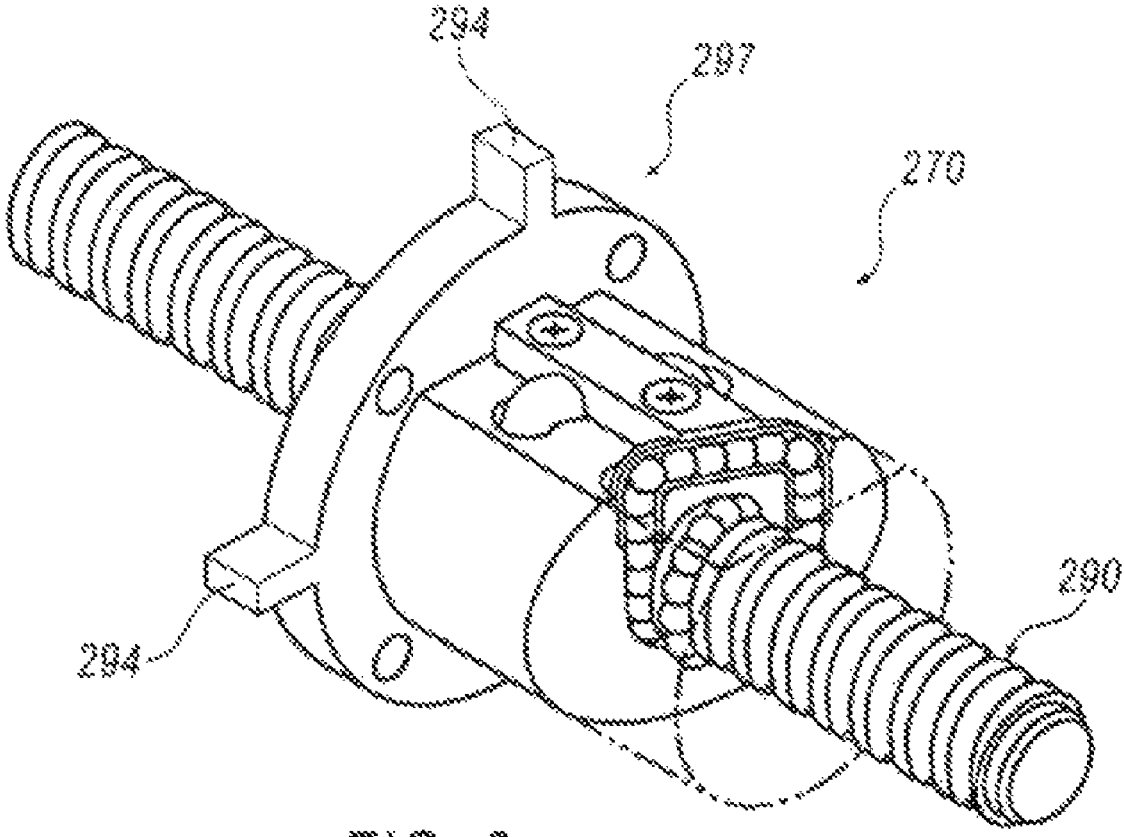
FIG. 6 is a perspective partial cut-away view of a ball screw.

Referring briefly to FIG. 6, the ball screw 270 includes a threaded screw 290 and a ball easing 292. The ball casing 292 is moveable along the axis A-A within the outer casing 278 and may include tabs 294 that engage slots (not shown) within the outer casing 278 such that the ball casing 292 does not rotate relative to the outer casing 278. As the screw 290 rotates, the ball casing 292 will move axially within the outer casing 278. The member 28 is attached to the ball casing 292. Referring back to FIG. 5, the motor 272 is attached to the screw 290 such that supplying power to the motor 272 will rotate and counter-rotate the screw 290, thus causing the member 28 to extend from and retract into the outer casing 278. In the embodiment illustrated, the member 28 will extend between a distance D1 (FIG. 1) and a distance D3 (FIG. 3). The difference between the distance D1 and the distance D3 is about eighteen (18) inches (about 46 centimeters).

The load cell 274 is positioned so as to detect the amount of force F that is applied in the direction D to the joint 40. The force F is the urging force that extends the joint 40 (reduces the angle α). In operation, the amount of force F may vary, as desired, and is monitored to prevent the application of an undesired amount of force on the joint 40.

The microprocessor 262 is in communication with the sensors 276 via an input link 300 to receive input from the sensors 276 and control the operation of the motor 272, as discussed in greater detail below.

As best seen in FIG. 5, the microprocessor 262 is in communication with the motor 272 via an output link 302 to control the operation of motor 272. The microprocessor 262 is also in communication with a user interface 306 via a user link 308. The user interface 306 is used to control operation of the apparatus 20. The microprocessor 262 may control the speed of the rotation, the speed of counter-rotation, and the torque of the motor 272. Accordingly, the microprocessor 262 can control the axial movement of the member 28 and the speed of axial movement of the member 28. Additional the microprocessor 262 can control the torque of the motor 272 so as to limit the force F applied to the joint 40.

The sensors 276 include a torque sensor 330, and a linear position sensor 334. The torque sensor 330 measures the torque of motor 272 applied to the ball screw 270 and the linear position sensor 334 detects the height of the member 28 relative to the outer casing 278 (an encoder may be used). The microprocessor 262 may use the torque applied by the motor 272 to calculate the force F. The microprocessor 262 may use the output from the linear position sensor 334 to provide a readout that indicates the angle α or the distance, such as distances D1, D2, D3.

Figure 7:
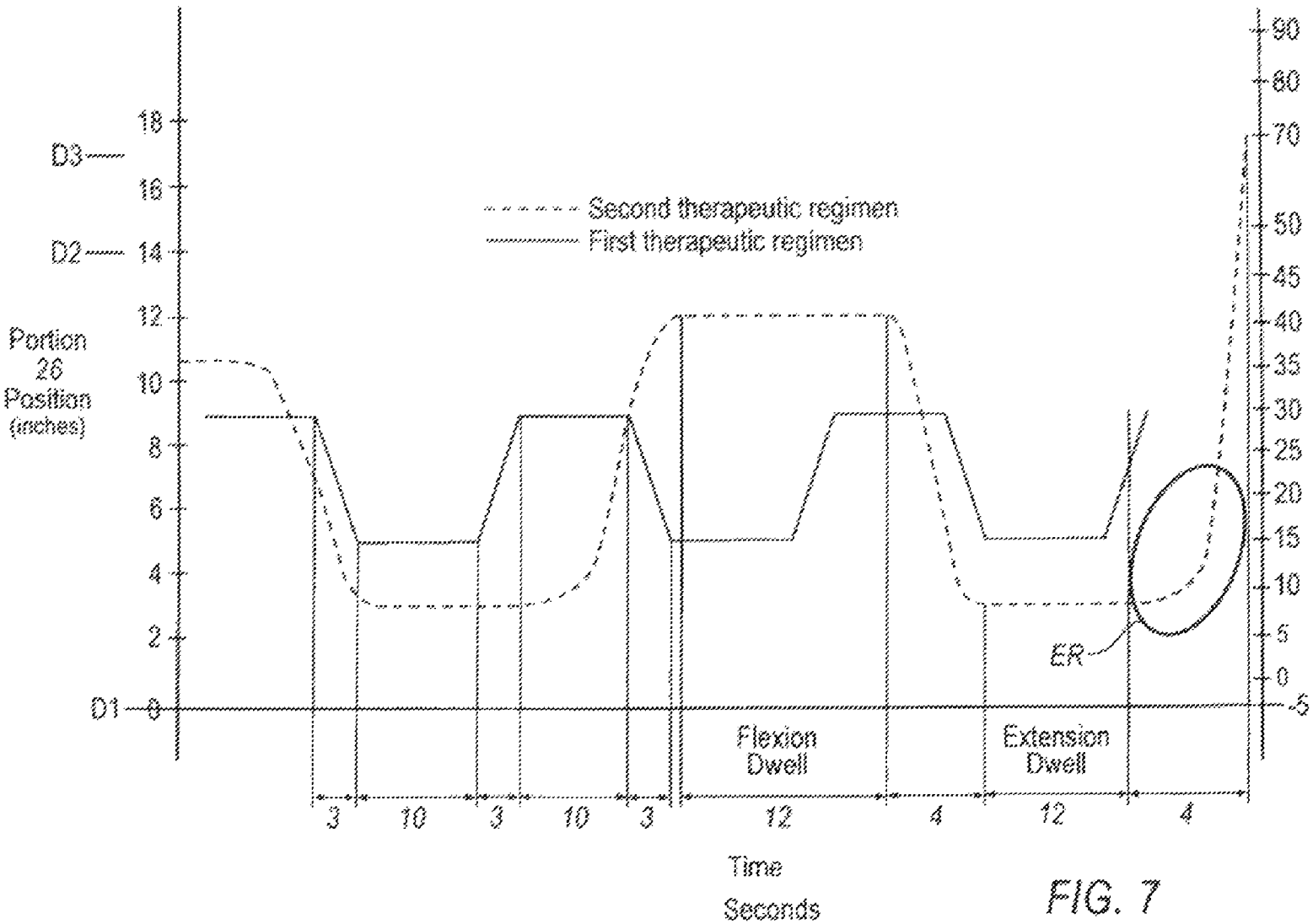
FIG. 7 is a diagram illustrating potential operations of the apparatus of FIG. 1.

As best illustrated in FIG. 7, two potential operations of the apparatus 20 are overlaid for comparative purposes. A first therapeutic regimen is shown where the joint 40 is moved between an angle α of 30° and an angle of 13°. As illustrated, the joint 40 is held at an angle α of 30° for 10 seconds, rotated to the angle of 13° during a time of about 3 seconds, held at the angle of 13° for 10 seconds (dwell), and returned to the of angle α of 30° for completion of one cycle.

A second therapeutic regimen is shown where the joint 40 is moved between an angle α of 80° and an angle of 0°. As illustrated, the joint 40 is held at an angle α of 80° for 12 seconds, rotated to the angle of 5° during a time of about 4 seconds, held at the angle of 5° for 12 seconds, and returned to the of angle α of 80° for completion of one cycle. FIG. 7 also illustrates the position of the portion 26, in inches, measured with 0 inches representing a fully extended position of the member 28 from the drive mechanism 24 and 18 inches representing a fully retracted position of member 28 within the drive mechanism 24. In a potential therapeutic session, the joint 40 is exercised through about 100 cycles, although more or less cycles may be prescribed or performed, as desired.

Figure 8:
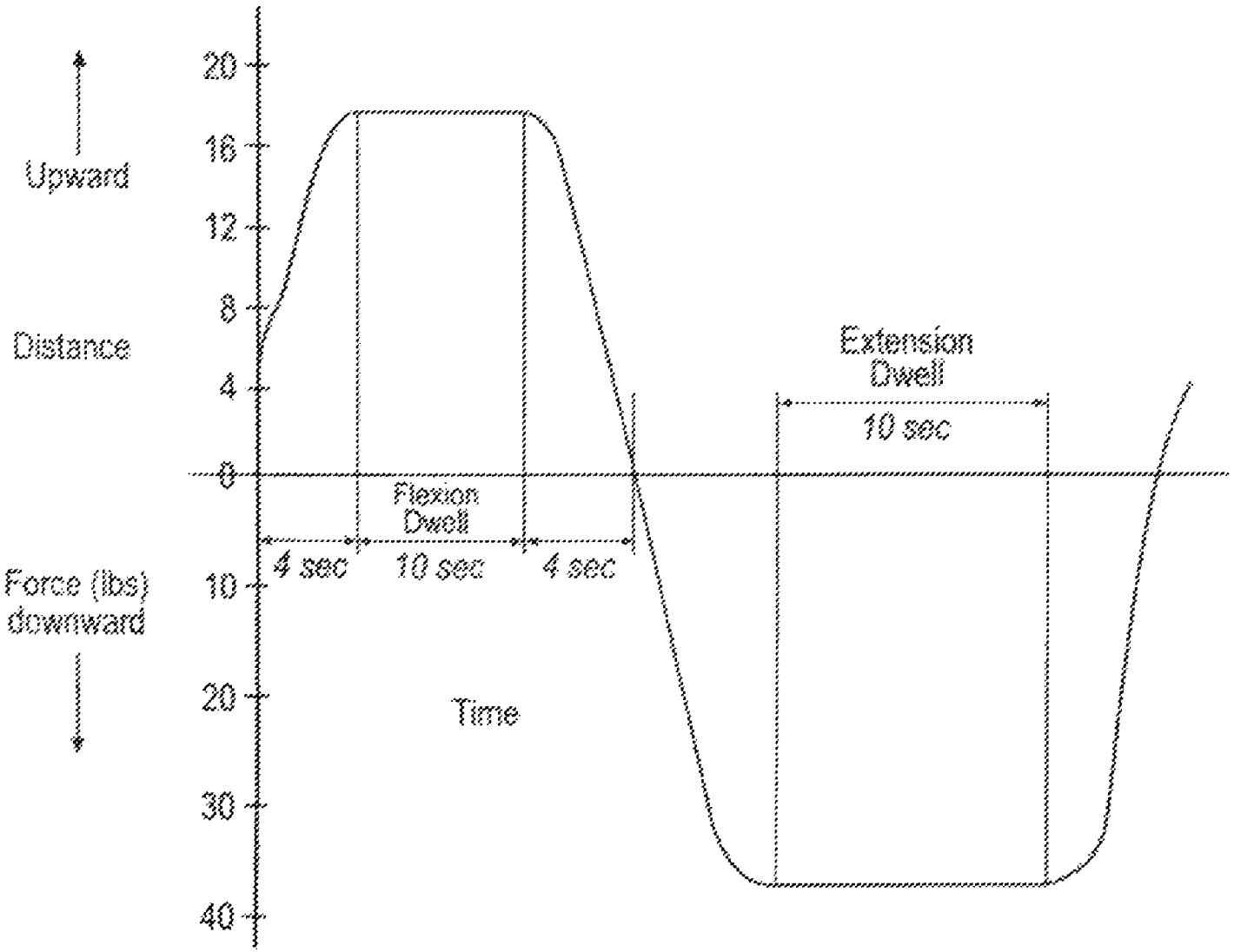
FIG. 8 is a diagram illustrating another potential operation of the apparatus of FIG. 1.

FIG. 8 illustrates another operational mode of the apparatus 20. As illustrated, the microprocessor 262 will send signals to the drive mechanism 24 via the link 302 to operate the apparatus 20 in essentially a split mode where the portion 226 is lifted to a predetermined height (or corresponding angle α), held for a predetermined amount of time, and then lowered in the direction of the arrow D using a maximum force F (in lieu of lowering to a predetermined height or angle α). In the exemplary embodiment illustrated, the joint 40 is attached to the portion 226, then the portion 226 is raised to a height of about 17 inches (which may correspond to an angle α of about 120° for the individual patient) and held at about this height for about 10 seconds (flexion dwell). The joint 40 is then slowly lowered while microprocessor 262 monitors the load cell 274 and/or torque sensor 330 to detect the force F that is applied to the joint in the direction of the arrow U. The microprocessor 262 will send a signal to the drive mechanism 224 to move the portion 226 in order to maintain a force F of about 36 pounds (lbs) (80 kilograms). Once this force is achieved, the portion 226 may move in the direction of the arrow U or D in order to maintain the force F at about 36 lbs for a predetermined amount of time (extension dwell). In this operational mode, the apparatus will ensure that the joint is flexed to a desired angle α (or distance such as distance D3) while extending the joint 40 using a desired, constant force (which may also be referred to as pressure). It should be noted that the operational mode illustrated in FIG. 8 may result in the joint 40 moving in the direction of arrows U of D while the joint is in the extension dwell.

The angle α is controlled by the microprocessor during each cycle and may be input in a variety of ways. For example, the patient may initially strap the knee joint of the patient's other leg (not joint 40) within the apparatus 20 (similar to FIG. 5) and permit the microprocessor 262 to raise and lower the joint. As known values of angle α are attained, the patient may input the value of the angle into the user interlace. The microprocessor will then correlate the measured position of the member 28 (from sensors 276) with the angle of the knee joint. While not a direct measurement, this method will provide a close estimate of the actual angle α of joint 40 for a patient with anatomically similar legs. When a sufficient amount of measured angles are input into the microprocessor 262, the joint 40 may be then strapped into the apparatus 20 to exercise the joint 40 between desired angles of operation. Similarly, the joint 40 may be used to input actual measurements of the angle α into the microprocessor 262 as the joint 40 positioned within the apparatus 20 and rotated.

When the microprocessor 262 has values of the angle α input into a memory (not shown) of the microprocessor 262, the microprocessor 262 can control the rotation of the motor 272 to position the ball casing, and thus the member 28, between positions along the axis A-A that will correlate to the desired range of angles α. The microprocessor 262 can further control the speed of rotation of the motor 272 to control the speed of rotation of the joint 40 between a first angle and α second angle, as seen in FIG. 7.

As best seen in area ER of the illustrated second therapeutic regimen of FIG. 7, the microprocessor 262 may begin by slowly rotating the motor 272 and then increasing the speed of the motor 272 as the joint is moved between angles. To accomplish the gradual increase in speed, the patient may select a pre-programmed ease-of-transition option using the user interface 306. In this manner, the operation of the apparatus 20 can be altered by the patient while maintaining a desired therapeutic regimen to provide a more comfortable and gradual transition between a portion of a cycle where the joint is held at a predetermined angle and a portion of the cycle where the joint is being rotated. As will be appreciated, the microprocessor 262 may be programmed to provide any number of regimens of therapy for any number of patients.

Specifically, the microprocessor may be programmed to provide differing regimens of therapy for a patient during a rehabilitative period. That is, for example, the microprocessor may be programmed to rotate the joint 40 between angles of 30° and 10° for five sessions a day during one week, then rotate the joint 40 between angles of 50° and 8° for six sessions a day during a second week, then rotate the joint 40 between angles of 70° and 5° for live sessions a day during a third week, then rotate the joint 40 between angles of 90° and 3° for four sessions a day during a fourth week.

Accordingly, the joint 40 may be accurately and reliably exercised between known angles while not exceeding these angles. During the exercises described herein, components of the joint 40, such as ligaments, are being stretched to attain a desired range of motion. One concern with a controlled stretching of a ligament is that stretching the ligament beyond a desired amount may undesirably tear the ligament such that the joint 40 may not be capable of repairing the tear between sessions. Conventional methods of exercising a knee may not provide the degree of control required to ensure that a joint such as the joint 40 is not exercised beyond a desired angle during each cycle. Another concern during rehabilitation of a joint is that improper angles or speeds of rotation or numbers of cycles may increase recovery time or prevent a full recovery.

Additional regimens, such as regimens that involve increasing and/or decreasing the range of motion for exercising the joint 40 in successive cycles in a given session, may be programmed into the microprocessor 262 and selected using the user interface 306, as desired. The inventor of the apparatus and methods described herein has discovered that sessions involving multiple cycles using a force F of about 70 to 80 pounds (lbs) and flexing a joint 40 such as a knee, to an angle of around 90° during each cycle are beneficial to attaining a full range of motion after a knee surgery.

Another aspect of the apparatus 20 is that the microprocessor may record and transmit the relevant data from each session for each patient. Accordingly, when a patient exhibits a less than desirable range of motion of the joint 40 during rehabilitation, a doctor or physical therapist may access the recorded data via the user interface 306 to determine whether the patient has properly exercised the joint 40. Additionally, the apparatus 20 may send a notification to appropriate individuals if the microprocessor 262 is connected to a remote interface 320 via a communication pathway 322, such as a telephone or internet access. In this manner, a physical therapist, or other individual, may monitor the progress of patients who exercise joints multiple times a day with some assurance that the joint is being properly exercised. A patient may also use the user interface 306 to request a change in permitted regimens, and a physical therapist may remotely approve the change in regimen through the remote interface 320. As illustrated, any access via the user interface 306 may also be accomplished via the remote interface 320.

Advantageously, the apparatus 20 may record the maximum attained angle of extension for a given session and use this angle to select the regiment for a subsequent session. Also, microprocessor 262 may be programmed to determine the maximum achievable angle of extension and/or flexion. In this determination, the user interface may notify the patient that a measurement of the attainable range of motion is to be tested. The user interface 306 will recognize an acknowledgement by the patient and the microprocessor 262 will record the angle of extension as the member 28 is extended from the drive mechanism 24. When the patient enters a command into the user interface 306 to cease the test, the microprocessor will record and display the angle. In this manner, an actual angle may be measured while the joint is maintained at the angle for a brief amount of time to reduce patient discomfort associated with holding the joint at this angle for an extended period of time while previous methods of measuring the angle of the joint 40 are performed.

The apparatus 20 may provide a surgeon with the desired information of patient progress and which therapeutic regimens are more successful at attaining a desired range of motion in a desired amount of time. The apparatus 20 may also provide a physical therapist with a controlled, consistent therapeutic regimen for a patient that may be closely monitored while freeing the physical therapist for other duties during the regimen (possibly as the patient performs the rehabilitation at home). Since the performance of the cycles is recorded by the microprocessor, the resulting sessions may be printed in tabular form by connecting the microprocessor to a printer in lieu of manually recording the relevant data of each session. Furthermore, a surgeon, physical therapist, or other individual may compare the results of differing regimens for sufficiently large groups of similar patients to help determine which regimens are most beneficial for patients within the groups.

Preferably, the load cell 274 is adjusted to compensate for the weight of the knee engagement portion 226, although the weight of the apparatus 20 that exerts a downward force on the joint 40 may be compensated within the microprocessor 262, or ignored entirely.

In operation, the drive mechanism 258 is attached to the joint 40, generally as illustrated in FIG. 5, with straps 286, 288 retaining the first member 36 and the second member 38 in constant contact with the portion 226.

In the embodiments illustrated, the force F exerted on the joint 40 in the direction of arrow D may be measured and/or limited by the load cell 274 as described. The force F may also be measured and/or limited by a limit switch (not shown) in communication with the pressure valve 200, or by the microprocessor 262 as it reads the torque applied by the motor 272.

In the embodiment illustrated, the drive mechanism 58 is pneumatic, and the drive mechanism 258 is a ball screw mechanism, although other physical means of accomplishing the motion described herein may be used. As one would appreciate, the drive mechanism 258 provides a positive displacement for the portion 26 relative to the surfaces 30, 32 (excluding deflection within the support structure 44), while the drive mechanism 58 may experience an axial deflection as the patient exerts a force in the direction of arrow U, thus resulting in the drive mechanism 58 providing a non-positive displacement for the joint 40. That is, the drive mechanism 58 may permit the patient to move the portion 26 in the direction of the arrows D or U, while the drive mechanism 258 may prevent the patient to move the portion 26 in the direction of the arrows D or U, providing the capability to use a positive displacement or non-positive displacement drive, as desired.

Although the steps of the method of using the apparatus 20 are listed in a preferred order, the steps may be performed in differing orders or combined such that one operation may perform multiple steps. Furthermore, a step or steps may be initiated before another step or steps are completed, or a step or steps may be initiated and completed after initiation and before completion of (during the performance of) other steps.

As used throughout this specification, the terms "for example," "for instance," and "such as," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation. As referred to in this text, the following terms are generally defined as:

Cycle—Steps 1-4 as follows.

1. Flex the joint 40 as apparatus 20 pulls on posterior area of the joint 40
2. Hold in desired flexed position for a predetermined amount of time (flexion dwell)
3. Extend the joint 40 as apparatus 20 pushes on anterior area of the joint 40
4. Hold in desired extended position for a predetermined amount of time extension dwell)
5. Repeat, or Repeat Modified Parameter—a portion of a cycle that can be modified in a subsequent cycle, such as hold time, maximum force, angle of flexion, rate of change of angle $\alpha$ etc.

Repeat Modified—changing a parameter from the previous cycle.

Extended position—the minimum angle of flexion achieved during a given cycle.

Angle of flexion—not inconsistent with general medical terminology, typically the angle between major bones of the joint (such as the femur and tibia for a knee joint), measured with a goniometer, or other device.

Range of Motion (ROM)—the range of angles of flexion for a given joint, either actual or desired or typical. Typically, a knee joint has a ROM of about 135° in full flexion to about −5° (hyperextension) in full extension.

Full flexion—a joint that is bent as far as it can.

Full extension—a joint extended as far as it can, generally, 0°, although a few degrees of hyperextension in a joint is normal, especially in a knee.

Dwell—maintaining the joint 40 in a position, determined by force required to attain the position, or angle $\alpha$ at the position, for an amount of time prior to moving the joint to another position.

Arthrofibrosis—a loss in range of motion in a joint, typically the inability to reach full extension in the joint 40 after intraarticular anterior or posterior cruciate ligament reconstruction.

Inflammation—a condition of distress of body tissues, a protective cellular response is triggered where blood flow is increased and the area becomes red, warm and swollen. Increasing range of motion of a joint will typically involve some inflammation.

The Knee Pad—the portion 26 of the apparatus 20 that contacts the anterior area of the joint 40 when the joint 40 is a knee. This pad may contact directly above the joint 40, or above the lemur and tibia near the joint 40. The ankle and hip rest on a generally level surface provided by support members 30 and 32.

The Knee Strap—the portion of the apparatus 20 that contacts the posterior area of the joint 40 when the joint 40 is a knee. This strap may wrap around the joint 40 and be connected by Velcro®.

Session—Therapeutic session—a progressive number of cycles without any appreciable rest, an example being 100 cycles over a time of about 45 minutes. Generally, a patient may perform multiple sessions per day, as directed by a physical therapist, or surgeon.

Therapeutic regimen (Rehabilitation protocol)—The steps taken post operation to restore function of the joint, including (broadly) exercising the joint, restoring full range of motion, regaining strength, and (specifically) locking the joint 40 joint at full extension in a brace, flexing the joint 40 to a desired angle of flexion, etc.

Method Specifics

The joint 40 may be extended to a predetermined position, or may be extended using a maximum force, or the microprocessor may use an algorithm that includes positions and forces as inputs. If a predetermined position is desired, the microprocessor will extend the joint 40 until that position is achieved (Step 1), then hold the position in step 2. If a maximum force is desired, the microprocessor will extend the joint 40 until the maximum force is achieved, then hold that position (Step 2). The algorithm would be established after prolonged use of the apparatus 20 produces data that can be used to optimize a therapeutic regimen for a general class of patients.

The use of the apparatus 20, as opposed to a physical therapist who manually forces the joint toward extension or flexion, permits an accurate application of force (such as the force F) that is constant during a cycle, or permits the joint to be forced to a specific angle of flexion and held at that specific angle for a predetermined amount of time. A therapist may have difficulty in estimating whether the specific angle or force is maintained, and may not be permitted the time to exercise the joint 40 for extended periods of time or perform the rehabilitation many times per day or on weekends. A patient who is permitted access to the apparatus 20 during the entire regimen of therapy can use the apparatus 20 as often as prescribed with the physician and therapist having access to the actual, not estimated, rehabilitation protocol.

One feature of the apparatus 20 is that relative low amounts of force may be used over relatively longer periods of time during a session to restore full range of motion of the joint 40 while reducing or eliminating the amount of swelling typically associated with post-operative the joint 40 surgery. Currently, a therapist performs rehabilitative processes on a joint about twice a week after joint surgery (possibly due to restraints by a patient's availability or actual time available for the therapist to see the number of patients). The therapist typically uses a relatively larger amount of force over relatively shorter periods of time (sessions) to restore full range of motion of the joint. This technique results in inflammation of the joint which restricts range of motion of the joint. Since the inflammation involves swelling of the joint area after therapy, the patient will typically experience swelling after leaving the therapist's office, requiring the use of ice and anti-inflammatory drugs to reduce swelling.

The apparatus 20 permits a physician or therapist to control the rehabilitation of a joint post surgery with increased accuracy, thereby permitting additional focus on other aspects, of rehabilitation, and allowing one to rule out inadequate range of motion exercises if difficulty arises in establishing a full range of motion.

Real Time Measurement

The apparatus 20 can detect the amount of movement of the knee pad as the joint 40 is extended, and thus, the distance that the joint 40 was moved relative the hip and foot. Also, the apparatus 20 may be calibrated with known angles of flexion for a given patient (and a given knee pad, since several differing sizes of knee pads will be supplied to accommodate differing patients and joints) in order for the apparatus 20 to correlate the angle of flexion with the spatial position of a point associated with the knee pad. Therefore, the apparatus 20 can measure the angle of flexion of the joint 40 as the joint is extended. If the physician or therapist prefers, the measurement may reflect the distance that the knee cap (or some other portion of the joint 40) must travel in a direction generally perpendicular to a line drawn between the ankle and the hip, to reach full extension.

Since the knee pad is self centering, the measurements are accurately repeatable for the sessions. As a patient's leg musculature increases with an increase in strength (that may have been lost after injury due to limited motion) the patient may recalibrate the apparatus 20 by measuring the angle of flexion with a separate machine during use of the apparatus 20 while inputting the measured angles into the microprocessor interface.

Real Time Control

Since the apparatus 20 may be used on many patients, the microprocessor can store limits and other data specific to each patient and require a log-in each time the apparatus 20 is used in order to ensure that each session for a specific patient is recorded. Also as the limits (such as limits on flexion or cycles per session) may be changed for progressive sessions, the microprocessor may have a pre-recorded series of therapeutic sessions that are performed on a given patient.

Since one microprocessor may control multiple apparatus 20, or one microprocessor may be connected to communicate with the microprocessors of multiple apparatus 20, a patient's therapeutic regimen may be accessed automatically by any apparatus 20 when the apparatus 20 communicates with a microprocessor that contains the necessary information. Also, the apparatus 20 may contact the central microprocessor, or the therapist or physician, if any parameter is/are outside of an expected, or safe, range, based upon predetermined ranges or algorithms that calculate ranges. (For example, a third week post-operative patient who has had angles of flexion of about 15° in the first week, and about 10° in the second week, may have a regression to 15° at the beginning of, or during a session, or a larger force may be required to reach a desired angle of flexion during a session. This information may be recorded and flagged for attention to the physician or therapist that reviews the data, or the physician or therapist may be contacted immediately (pager, cell phone, or local alarm) and require a confirmation by the therapist physician prior to resumption of the therapy.)

Real Time Feedback

The microprocessor may also transmit to the patient (using the screen or speakers) information concerning the therapeutic regimen, including:

1. The level of pain that is normally associated with a given angle of flexion or amount of force used to extend the joint (possibly on a scale of 1-10, or compared to other known pain).

2. Progress during a session and/or cycle (amount of movement, degrees of flexion, number of cycles remaining).

3. The amount of time remaining in a position, (providing a countdown for the initiation of the next movement of flexing or extending the joint).

This feedback may be used by the patient to record information such as: whether the amount of pain experienced was higher than normally experienced, whether the amount of pain experienced was higher than the level identified by the microprocessor as normally experienced by others, etc.

This information recorded by the patient may be transmitted to the therapist and/or physician, or may be stored in the patients file. Historical data recorded by patients may be used to generate information, such as the information in item 1 immediately above. While these uses are not intended to eliminate the need for a physical therapist, they should alleviate the need for a physical therapist to constantly monitor a patient and may allow a patient to exercise a joint at home or other convenient place.

Data Recording

The apparatus 20 can record the amount of force used in each cycle, the angles of flexion of each cycle, the duration of hold times (dwell), the number of cycles performed in a session, the number of sessions performed per week (or whatever length of time is desired), etc. Whether the patient uses the machine supervised or unsupervised, an accurate recording is stored and available for later evaluation.

Therefore, more reliable data on the progress of therapy is available to the therapist and the physician. When a patient contacts a physician to notify the physician of a loss of range of motion, the physician can determine whether the loss in range in motion occurred more recently, or gradually. Also, the physician can determine whether the patient had performed the desired sessions, or had skipped, in whole or in part, any sessions.

Alternatively, the therapist may use the apparatus 20 for measurement only. For this use, the pneumatic cylinder 68 is vented to atmosphere or the hull screw 270 is permitted to rotate freely. In this use, the therapist would push on the knee pad to manually extend the joint, and the apparatus 20 would measure the duration of hold times, the angle of flexion, and the rate of change of angle of flexion. Also, the apparatus 20 could measure the amount of force used by the therapist with a load sensor (such as the load cell 274). These measurements could then be used to establish the therapeutic regimen using the apparatus 20. This may be used as a 'transition' step prior to exclusive use of the apparatus 20, until physicians and therapists gain sufficient confidence in the apparatus 20 and fully appreciate the benefits thereof. Importantly, using the apparatus 20 for measurement only may be useful to a therapist since data from the session can be recorded and the therapist may be notified by the apparatus of when a parameter (such as number of cycles in a session, force, or height that the knee is raised to between extensions) is not within an expected range.

Microprocessor Control

As mentioned, the microprocessor(s) are beneficial to the control of both the apparatus 20 and the therapeutic regimen. A therapist may allow a patient to use the apparatus 20 at home, or unsupervised in the therapist's office while maintaining control over the therapeutic regimen, and collecting an accurate diary of the exercises that were performed.

The microprocessor also ensures that the desired angle of flexion and/or maximum force is reached and not exceeded during each session. This helps to ensure that the joint is not damaged during therapy by working the joint beyond a desired angle of flexion, or working the joint 40 too close to full extension. (For Example, the therapist may input into the apparatus 20 a progressive limit for angles of flexion as: 1. No less than 20° in the first week post-operative. 2. No less than 15° in the second week post-operative. 3. No less than 10° in the third week post-operative, and 4. No less than 5° in the fourth week post-operative; and the microprocessor will ensure that these limits are maintained during each cycle.) Also, the microprocessor may notify the therapist/physician if limits are exceeded, if limits are not achievable, or if no limits are available for a future session.

The microprocessor may also permit a patient to advance the schedule toward full extension within an allowable range, or request an advancement as greater-than-normal progress is demonstrated. The therapist/physician may approve the advancement, or otherwise alter the regimen, thereby providing an interactive therapeutic regimen that can be tailored to the individual patient based upon progress. Also, the accuracy of the data (measured in degrees of angle of flexion, force required to each a certain angle of flexion, number of cycles per session, number of cycles completed, etc.) will permit the therapist/physician to have more confidence in the decision to alter the course of treatment (which may include differing rehabilitative techniques and surgical procedures).

At the end of a therapeutic regimen for a specific patient, the microprocessor can download data in a variety of formats. One possible format is the progress toward full extension or full flexion as a function of time.

Additionally, the microprocessor may communicate with other equipment (stair climber, treadmill, bicycle, quadriceps weight machine, etc.) to accumulate data regarding other rehabilitation activities on a specific patient. Printouts or graphs could include data from all measurable sources of therapy in order to more accurately track the progress of a patient during rehabilitation. Further, the microprocessor may automatically detect whether the patient is using the correct knee pad, or may ask the patient or therapist to confirm that the proper knee pad is in use prior to each session.

Physician Evaluation—Data Management

Since more reliable and more complete data on the progress of rehabilitation is available to the physician and therapist, difficulties for a specific patient may be identified earlier. Additionally, since undesirable forces and ranges of motion are avoided, a shortened time required to establish a full range of motion may be experienced.

The microprocessor may automatically print charts of a patient's progress (with normal results based upon the patient's age and other factors) for comparison to goals and determination of further therapy, if any.

Studies—Data Management

Data with the patients' names removed may be used to identify the more successful rehabilitation protocols. This data, presumably recorded for several distinct protocols, includes measurements of maximum and minimum angles of flexion compared to time, periodicity of cycles, other equipment used, and goals on this equipment. Currently, this data is recorded in differing formats and is difficult to assemble, analyze and compare. Importantly, this data is not just the goals established for a given protocol, but the actual measurements taken during rehabilitation.

Air Cylinder

Since a patient is generally in some degree of pain after surgery, slow, constant motions are preferable to sudden motions during flexion and extension of the joint. The use of an air cylinder for movement of the knee pad avoids the jerking motions usually associated with other mechanical means of movement. Additionally, the air cylinder is quieter, lighter, more reliable, more accurate for linear measurement, and easier to maintain than many other mechanical means of movement.

Consistent Treatment

Since the apparatus 20 will produce consistent, measured results, the inaccuracies associated with having differing therapists estimating the angle or flexion (even with a goniometer) and amount of force exerted is eliminated. Also, the patient may experience a great amount of pain if the therapist loses balance during the joint 40 extension exercise and suddenly exerts a large, unintended amount of force on the patient's joint.

Muscle Spindle Fibers

The inventor has discovered that beginning a cycle by flexing the joint 40 and then slowly extending the joint 40 has beneficial effects. The inventor has also discovered that maintaining a constant pressure during extension dwell has beneficial effects, especially when coupled with a lower force F (on the order of about 25-35 lbs) and a session involving about 100 cycles in about 45 minutes.

One possible explanation for these observed benefits is the medical observation the muscle fibers, especially muscle spindle fibers found in the center, or belly, of a muscle will extend to a greater length (using the same force) if these fibers are first contracted then extended. That is, a muscle, such as the ham strings or calf muscles on either side of a knee joint, are more amenable to flexion when first contracted.

Another possible explanation for these observed benefits, that may work in conjunction with the possible explanation above, involves the brain and its protective mechanisms for the joint and muscles, especially when presented with an injured joint, or a joint that will not extend to a 'normal' degree of extension. Importantly, this is based upon the understanding that the brain and body work in a closed system and that the body cannot be manipulated without concurrence or resistance by the brain. This line of reasoning follows that—when a joint, such as a knee, is injured and especially after surgery when the knee will not extend to an expected degree of extension (or hyperextension), the brain seeks to protect the joint from further injury. Therefore the brain will send signals to contract the hamstrings and calf adjacent the knee to prevent pain and/or further damage. Since the hamstrings and calf are in a state of chronic (or habitual) contraction, beginning a cycle with extension (as most therapists do) will result in the brain detecting that these muscles are under a force to cause extension, and the brain may naturally send a signal to these muscles to contract. This signal from the brain to contract may result in damage to the joint that may cause tearing of fibers (muscle, ligament, tendon) resulting in inflammation. This signal from the brain also works against attempts to extend the knee.

With close reference to the example of FIG. 8, this line of reasoning continues that—if the knee is first brought into flexion (an angle of about 100°-135°, and preferably an angle α of about 120°), the brain will detect that the knee is no longer under any need of protection and will, at least after a sufficient flexion dwell time, cease sending a chronic signal for contraction to the hamstrings and calf adjacent the knee. It is thought that the brain will then send a signal to extend the joint, or at least be more amenable to a force to extend, after the flexion dwell. (It has been found that a flexion dwell of about 10 seconds is sufficient for the patients tested.) The knee now may be slowly extended toward an extended position. The rate of extension of a joint (such as the knee) after flexion is important since in the event that the brain senses that the injured joint is extending too fast the brain may redevelop a contraction signal (to protect the muscle/joint), thereby defeating the flexion and flexion dwell. The inventor has found that extension of the joint in a minimum of 3 seconds (with a preferred range of 3 to 5 seconds) from the flexion dwell to the extension dwell is adequate for the patients tested (and for the inventor's post operative recovery knee as well). It has been found that an extension dwell of about 10 seconds is sufficient for the patients tested. Thus extended, the potential for the brain to work against the extension of the joint during the extension dwell and the potential for the muscle spindle fibers to work against the extension of the joint during the extension dwell are reduced, if not eliminated. Stated differently, exercising a joint should be performed while working with the body and with the brain (treated as a closed system) to prevent or reduce undesired effects.

The example of FIG. 8, where 100 cycles are repeated in about identical fashion to the cycle illustrated, is essentially impossible for a physical therapist to perform manually, or with typical machines. The inventor has found that this therapeutic regimen will reduce swelling, reduce fluid buildup, is less painful, involves less trauma, and provides a faster recovery time.

Furthermore, the muscle fibers may develop a tendency to contract ('memory') irrespective to the signals from the brain in a joint that will not fully extend. To counteract the muscle's tendency to contract, flexion of the knee to about 120° and first bring the knee to a flexed (or over-flexed) position, may 'erase' the 'memory' to contract, thereby permitting the muscles, such as the hamstrings and calf to extend without any residual resistance.

Additionally, the apparatus 20 and methods of use described herein may permit a patient to more accurately integrate a rehabilitative protocol into other movement protocols, such as the Feldenkrais Method.

As described above in reference to FIG. 5, a microprocessor, such as the microprocessor 262, is in communication with the drive mechanism 24 and a remote interface 320. In an embodiment, the microprocessor 262 may also be connected to a communication device 410, as discussed below. In one embodiment, the communication device 410 includes an accelerometer 420, a memory 422, and a wireless transmitter 424 such as a Bluetooth transmitter. In use, the accelerometer 420 may detect data indicative of a user's gait, store the data in a memory 422, and transmit the data via the transmitter 424 to the apparatus 20 during use of the apparatus 20, or at any other time. Further, the device 410 may be a smartphone capable of transmitting the data by email or other transmission to a health care professional for evaluation.

Figure 9:
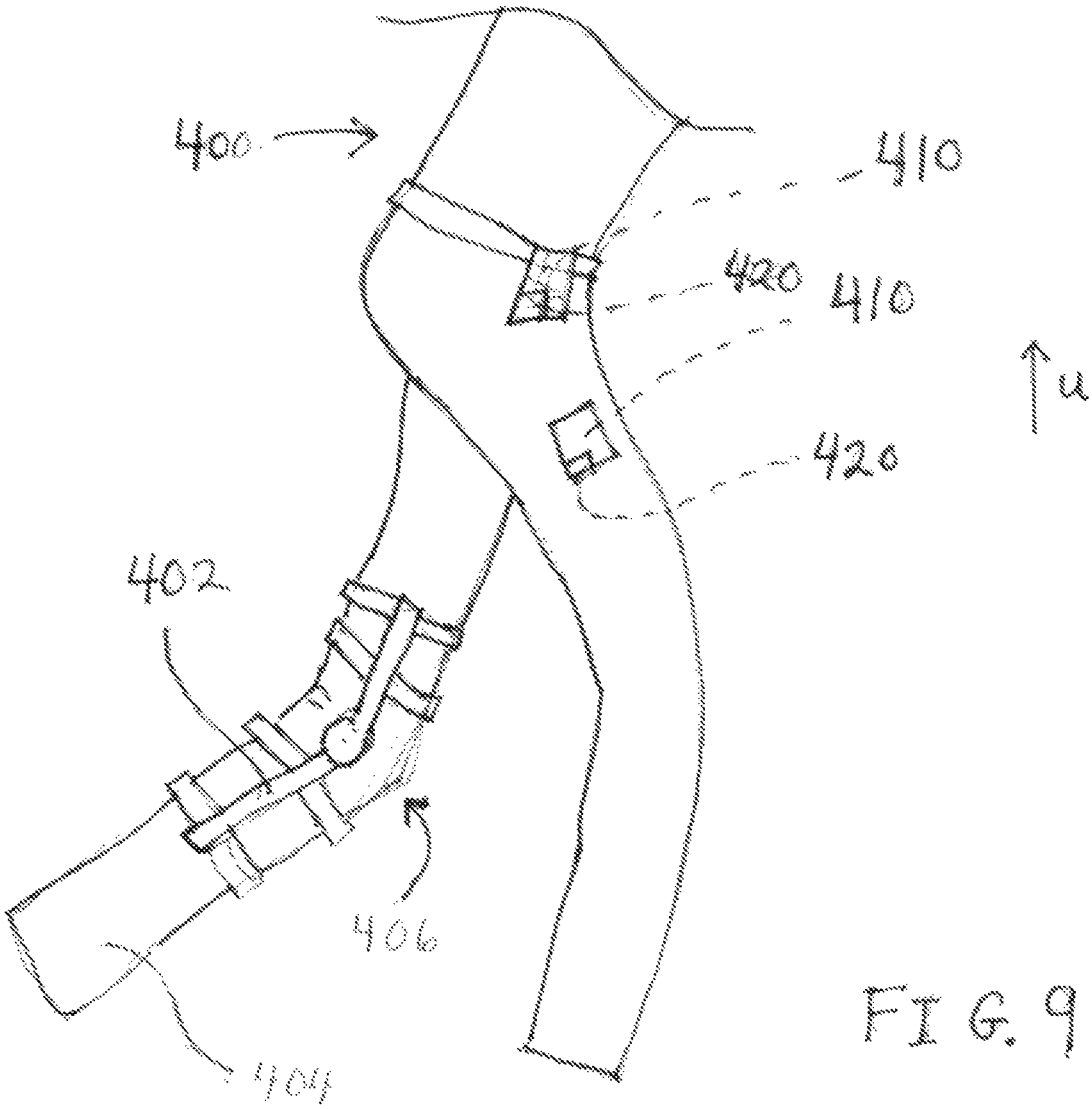
FIG. 9 is a view of a patient with a knee brace and mobile device.

FIG. 9 illustrates a user 400 with a knee brace 402 coupled to a leg 404. In the embodiment illustrated, the knee brace 402 is secured to the leg 404 such that a knee 406 articulates within the knee brace 402. That is, the knee brace 402 may limit the range of motion of the knee 406 as the user moves. The user 400 is further illustrated having a communication device 410 attached to the waistband (and alternatively in a pocket).

Figure 10:
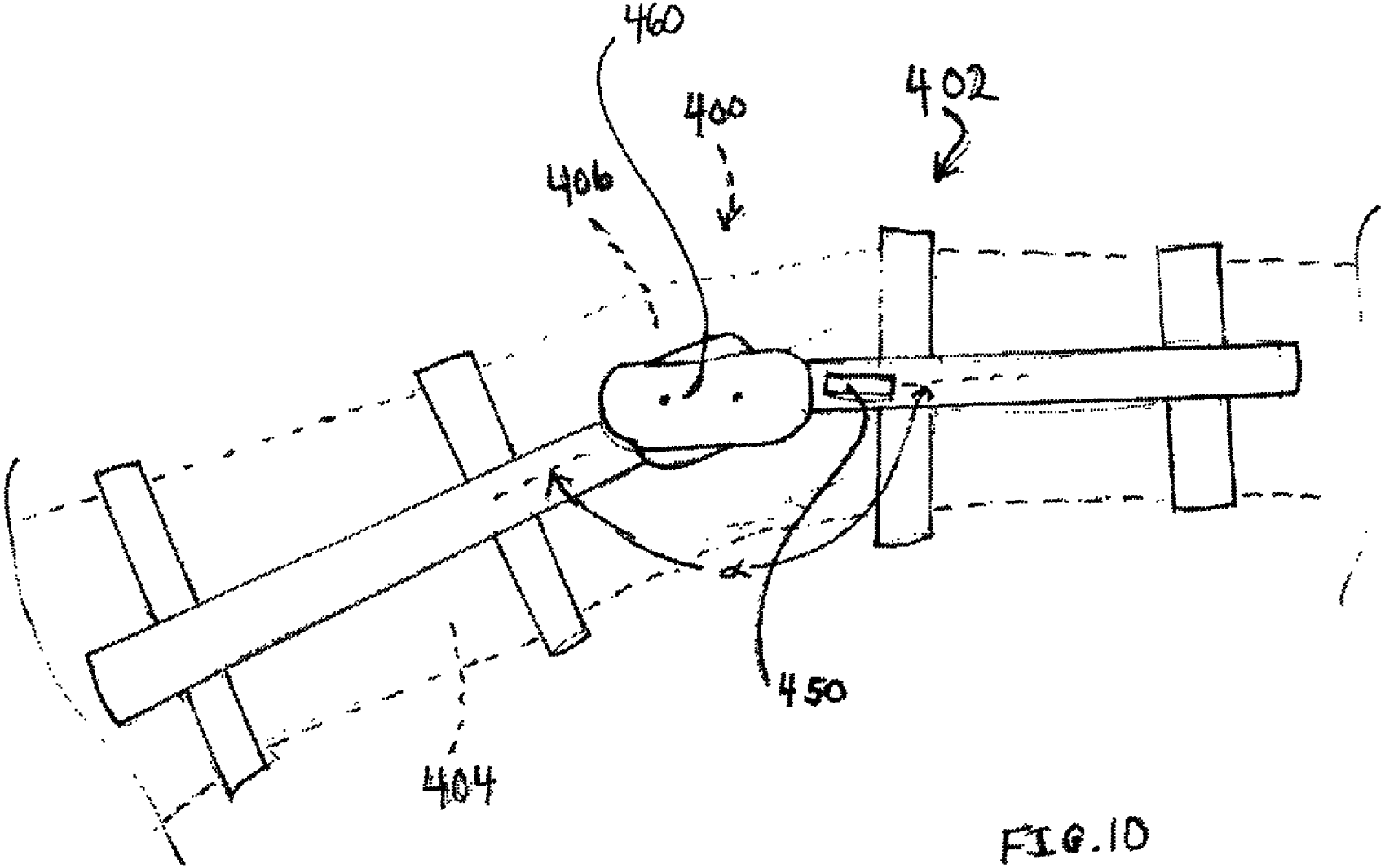
FIG. 10 is a side view of the knee brace of FIG. 9.

FIG. 10 illustrates the knee brace 402. In one embodiment the basic knee brace 402 is identical to the knee brace disclosed in U.S. Pat. No. 4,817,588 to Bledsoe, entitled "Motion Restraining Knee Brace." The knee brace 402 includes a first member 430, a second member 432, a plurality of restraining portions 434 restraining the first member 430 and the second member 432 to a user's leg, and a hinge portion 436 interconnecting the first member 430 to the second member 434. In operation, the hinge member permits the first member 430 to rotate relative to the second member 432 along an axis that is approximately the same as the axis of rotation of the user's leg at the knee. Further, the knee brace may include an extension limiting mechanism 438 and a flexion limiting mechanism 440.

The knee brace 402 may also include a data module 450. In an embodiment, the data module 450 includes an accelerometer 452, a memory 454, and a transmitter 456. The accelerometer 452, the memory 454, and the transmitter 456 may operate in similar manner to the device 410 by recording data indicative of the user's gait and transmitting the data to a health care provider. In an embodiment, the accelerometer 452 is a three-axis accelerometer. Further, the data module 450 may include a three-axis gyroscope 458 to provide the orientation of the data module 450 relative to the accelerations measured.

The knee brace 402 may also include a sensor for detecting the angle of extension of the user's knee 406. That is, the hinge portion 436 may include a sensor module 460, such as a hall effect sensor or other device, to sense the angle α of the knee 406 as the user 400 moves the leg 404. Further, the sensor module 460 may be as described in U.S. Pat. Nos. 4,667,685, 4,986,280, or US Patent Application Publication 2002/0143279. Additionally, the sensor module 460 may be in communication with the data module 450 for recording the angles of the knee 406 during walking or rehabilitative exercises.

Further, the sensor module 460 may be used as the user 400 is walking to determine the angles of the knee indicate whether the user is walking normally, as discussed in greater detail below.

Figure 11:
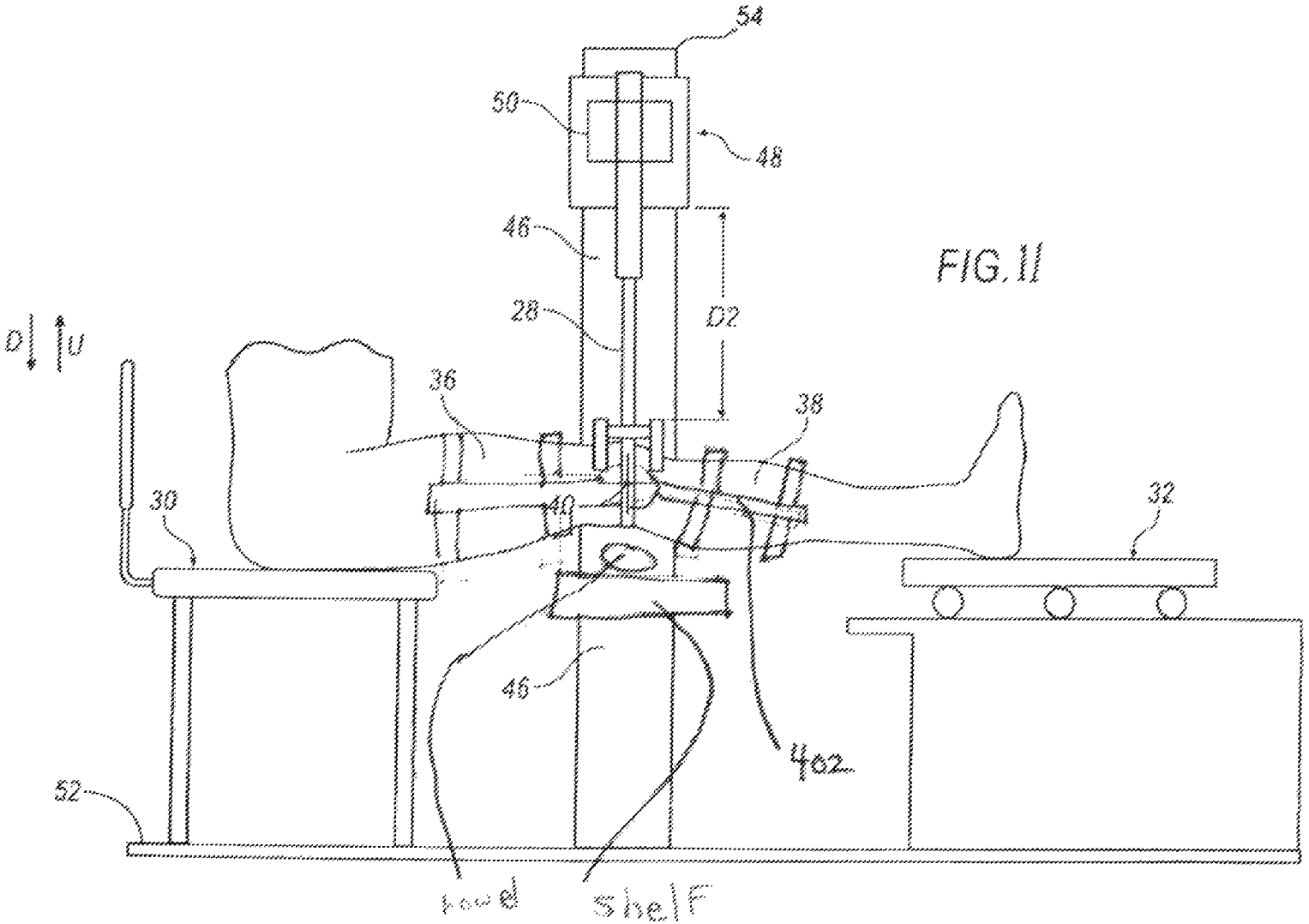
FIG. 11 is a side view of a user using the apparatus of FIG. 5 with the knee brace of FIG. 9, in an embodiment.

FIG. 11 illustrates the knee brace 402 used in conjunction with the apparatus 20. In an embodiment, the knee brace 402 may be worn while using the apparatus 20 in order to limit the range of motion of the knee.

FIGS. 12-14 illustrate an embodiment of the data recorded by an accelerometer, such as the accelerometer 420 or the accelerometer 452, while the user 400 is moving. In the embodiments illustrated, the accelerations measured are generally in the vertical direction U (FIG. 9). Specifically, FIG. 12 is a graphical illustration of data as the user 400 is walking. FIG. 13 is a graphical illustration of data as the user 400 is limping. FIG. 14 is a graphical illustration of data as the user 400 is using crutches. Accordingly, as the graphs of FIGS. 12-14 have a predictable difference, a health care professional may receive a graph of a patient that has an accelerometer, such as the accelerometer 420 or the accelerometer 452, and determine whether the patient has been limping or using crutches during a desired period of time. Therefore, the health care professional is provided additional data when assessing the rehabilitation of the patient.

FIGS. 15-17 illustrate an embodiment of the data recorded by a sensor, such as the sensor module 460, while the user 400 is moving. In an embodiment, the sensor detects a value representative of the angle α (FIG. 10) as the user 400 moves and transmits the value as data to a device, such as the communication device 410 or the apparatus 20. Specifically, FIG. 15 is a graphical illustration of the data as the user 400 is walking. FIG. 16 is a graphical illustration of data as the user 400 is limping. FIG. 17 is a graphical illustration of data as the user 400 is using crutches. Accordingly, as the graphs of FIGS. 15-17 have a predictable difference, a health care professional may receive a graph of a patient that has sensor, such as the sensor module 460, and determine whether the patient has been walking normally, limping or using crutches during a desired period of time. Therefore, the health care professional is provided additional data when assessing the rehabilitation of the patient. Further, the health care professional may then change the operation of the apparatus 20 based upon the data received from the sensor 460.

Other aspects of additional embodiments include:

Inputting pain information into device during use and transmitting pain information.

A smart phone application to use a smart phone accelerometer to estimate gait to approximate whether patient is limping or using crutches.

Graphing the distance moved of the in units of time as the apparatus 20 exerts the downward force to determine when the patient resists the downward force.

Denoting times that pain was recorded on the graph to determine when the patient was in pain during the session by providing the user with a touch screen or other input device.

Overlaying graphs of multiple sessions on a single output page to see progress over a time period of several cycles (or days or weeks).

Computing a composite cycle based upon an average of the distance per unit time of each cycle to get an idea of the amount of patient resistance during a therapeutic session.

Transmitting the instances of estimated liming or crutch use from the smart phone to a health care provider.

Using the smart phone GPS to determine how far the patient walks during selected time periods, (between 0.5 and 3 miles per hour with a gait recognized by the accelerometers as walking gait.)

Permitting a health care provider to control the device with the patient to monitor patient response and to reduce occupational injury of the health care provider.

Notifying the health care providers when a parameter (such as pain or expected range of motion) is not within expected or acceptable parameters.

Permitting a health care provider to change parameters (such as force exerted on the knee) for operation of the device.

Permitting the patient to include a message to the health care providers to accompany each session results, (such as "my knee hurts this morning" or "I fell yesterday" or "the anti-inflammatory medicine seems to be working")

Using the device with a motion limiter (such as a towel or block of wood under the knee to prevent an undesired amount of knee extension) and requiring patient to confirm that the limiter is in place prior to start of the session, (an input into the touch screen that must be received before the microprocessor allows the device to move) [although the device can be programmed to prevent this undesired movement, some patients may be more comfortable with a limit that they can see vs. one that is in the code]

Providing a diversion on the touch screen (such as a game or movie) to distract the patient, thereby permitting the patient to relax while the knee is manipulated.

Permitting the device to receive information from other equipment or inputs (such as amount of time warming up (in a sauna or on an exer-cycle) and correlating this data with the data transmitted to the health care provider.

Data from accelerometer can be compared (manually or automatically using a graph recognition algorithm) to graphs of limping, walking normal gait, using crutches, etc to assist the health care provider in determining progress of patient. Further, the health care provider can detect when the user is not using the brace or is does not have the knee brace range of motion settings properly set. As is known, the brace can limit the range of motion of the joint (such as the knee) and be used during use of the device 20 to provide a second limit to prevent undesired angles being attained during manipulation.

As used herein, the term adjacent includes 'near.' The term adjacent also includes, but is not limited to, 'immediately next to.'

Although the steps of the methods may be listed in an order, the steps may be performed in differing orders or combined such that one operation may perform multiple steps. Furthermore, a step or steps may be initiated before another step or steps are completed, or a step or steps may be initiated and completed after initiation and before completion of (during the performance of) other steps.

The preceding description has been presented only to illustrate and describe exemplary embodiments of the methods and systems of the present invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope. The scope of the invention is limited solely by the following claims.

What is claimed is:

1. A method of exercising a joint of a patient's limb comprising:

actuating the joint in a first direction to flex the joint and move the joint to a flexed position using an actuation arm of an exercise device;

maintaining the joint in the flexed position with the actuation arm for a first predetermined period of time;

after expiration of the first predetermined period of time, actuating the joint in a second direction opposite to the first direction using the actuation arm to extend the joint until at an extended position a measured linear pressure between the actuation arm and the patient's limb equals a predetermined target linear pressure entered into a controller of the exercise device;

maintaining the joint at the extended position for a second predetermined period of time; and wherein pressure is exerted on the limb by the actuation arm at a point superior to the patient's foot in only a single direction when the joint is flexed, and at a point superior to the patient's foot in only a single direction when the joint is extended.

2. The method of claim 1, further comprising maintaining the measured linear pressure equal to the predetermined target linear pressure while the joint is in the extended position.

3. The method of claim 2, further comprising maintaining the measured linear pressure equal to the predetermined target linear pressure by moving the actuation arm.

4. The method of claim 1, wherein the measured linear pressure is measured with a load cell mounted to the actuation arm.

5. The method of claim 1, wherein the actuation arm is moved with an electric motor.

6. The method of claim 1, wherein the joint is a knee.

7. The method of claim 1, wherein the predetermined target linear pressure is between 20 pounds and 80 pounds.

8. A method for exercising a joint of a patient's limb comprising:

exercising the joint during a first exercise regimen at a first exercise facility according to first regimen data input into a first controller, the first regimen including actuating the joint with a first actuation arm of a first exercise machine to extend the joint until a first measured linear pressure between the actuation arm and the patient's limb equals a first predetermined linear pressure;

monitoring the patient's gait with a sensor attached to the patient, the sensor configured to record gait data of the patient, the gait data is recorded after the patient leaves the first exercise facility;

exercising the joint during a second exercise regimen at a second exercise facility according to second regimen data input into a second controller, the second exercise regimen including actuating the joint with a second actuation arm of a second exercise machine to extend the joint until a second measured linear pressure between the second actuation arm and the patient's limb equals a second predetermined linear pressure calculated based on the recorded gait data; and wherein pressure is exerted on the limb by the first and second actuation arms respectively at a point superior to the patient's foot in only a single direction when the joint is extended.

9. The method of claim 8, wherein the first exercise facility is the same as the second exercise facility, the first controller is the same as the second controller, the first actuation arm is the same as the second actuation arm, and the first exercise device is the same as the second exercise device.

10. The method of claim 8, further comprising connecting a brace to the patient's limb at the joint, the brace including the sensor.

11. The method of claim 8, further comprising connecting the sensor to one of the patient's limb or waist.

12. The method of claim 8, further comprising recording gait data representing whether the patient is walking normally, limping, or using crutches.

13. The method of claim 8, further comprising monitoring the patient's gait with an accelerometer included with the sensor.

14. A method for exercising a joint of a patient's limb comprising:

exercising the joint during a first exercise regimen at a first exercise facility according to first regimen data input into a first controller, the first exercise regimen including actuating the joint in a first direction to flex the joint and move the joint to a flexed position using a first actuation arm of a first exercise device, and actuating the joint in a second direction opposite to the first direction with the actuation arm to extend the joint until a first measured linear pressure between the actuation arm and the patient's limb equals a first predetermined target linear pressure;

monitoring the patient's gait with a sensor attached to the patient, the patient's gait monitored after completion of the first exercise regimen and after the patient leaves the first exercise facility, the sensor configured to record gait data of the patient;

exercising the joint during a second exercise regimen at a second exercise facility according to second regimen data input into a second controller, the second regimen data including gait data recorded by the sensor and a second predetermined target linear pressure based on the recorded gait data, the second exercise regimen including actuating the joint in the second direction opposite to the first direction with a second actuation arm of a second exercise device to extend the joint until a second measured linear pressure between the actuation arm and the patient's limb equals the second predetermined target linear pressure; and wherein pressure is exerted on the limb by the first and second actuation arms respectively at a point superior to the patient's foot in only a single direction when the joint is extended.

15. The method of claim 14, wherein the first exercise facility is the same as the second exercise facility, the first controller is the same as the second controller, the first actuation arm is the same as the second actuation arm, and the first exercise device is the same as the second exercise device.

16. The method of claim 14, further comprising connecting a brace to the patient's limb at the joint, the brace including the sensor.

17. The method of claim 14, further comprising connecting the sensor to the patient's limb.

18. The method of claim 14, further comprising connecting the sensor to the patient's waist.

19. The method of claim 14, further comprising recording gait data representing whether the patient is walking normally, limping, or using crutches.

20. The method of claim 14, further comprising monitoring the patient's gait with an accelerometer included with the sensor.

* * * * *